United States Patent [19]

Umemoto et al.

[11] Patent Number: 4,696,893

[45] Date of Patent: Sep. 29, 1987

[54] COLOR PHOTOGRAPHIC MATERIAL CONTAINING CERTAIN COMBINATIONS OF CYAN AND MAGENTA COUPLERS

[75] Inventors: Makoto Umemoto; Kotaro Nakamura; Nobuo Furutachi, all of Kanagawa, Japan

[73] Assignee: Fuji Photo Film Co., Ltd., Kanagawa, Japan

[21] Appl. No.: 781,603

[22] Filed: Sep. 30, 1985

Related U.S. Application Data

[63] Continuation-in-part of Ser. No. 740,455, Jun. 3, 1985.

[30] Foreign Application Priority Data

Jun. 1, 1984 [JP] Japan ..... 59-112558

[51] Int. Cl.[4] ..... G03C 7/32; G03C 1/40

[52] U.S. Cl. ..... 430/543; 430/505; 430/512; 430/549; 430/552; 430/554; 430/556

[58] Field of Search ..... 430/549, 554, 552, 556, 430/512, 505

[56] References Cited

U.S. PATENT DOCUMENTS 4,264,723 4/1981 Ichijima et al. ..... 430/555

4,351,897 9/1982 Aoki et al. ..... 430/555

*Primary Examiner*—John E. Kittle

*Assistant Examiner*—Mukund J. Shah

*Attorney, Agent, or Firm*—Sughrue, Mion, Zinn, Macpeak, and Seas

[57] ABSTRACT

A silver halide color photographic material capable of providing color images having good coloring properties and being excellent in color reproducibility even in a developer using hard water, which contains a cyan coupler represented by formula (I) or (II) and 5-pyrazolone magenta coupler having an arylthio group at the coupling position of said coupler, wherein said arylthio group includes an aliphatic oxy group or an aromatic oxy group at an ortho-position with respect to the sulfur atom of the arylthio group, the aliphatic group or aromatic group of said aliphatic oxy group or aromatic oxy group being unsubstituted or substituted by at least one member selected from (a) a halogen atom, (b) a cyano group, (c) an unsubstituted or substituted aliphatic, aromatic, or heterocyclic sulfonyl, sulfinyl, or phosphonyl group, and (d) a group represented by the formula (e) a group represented by the formula $\leftarrow A_2\text{-}M)_nB_2$; and formulae (I) and (II) are represented by (I)

and (II)

wherein symbols in formulae have the same significances as described in the Detailed Description of the Present Invention.

11 Claims, No Drawings

COLOR PHOTOGRAPHIC MATERIAL CONTAINING CERTAIN COMBINATIONS OF CYAN AND MAGENTA COUPLERS

CROSS-REFERENCE TO RELATED APPLICATIONS

This is a continuation-in-part of application Ser. No. 740,455, filed June 3, 1985.

FIELD OF THE INVENTION

This invention relates to a color photographic material, and more particularly to a high-quality color photographic material which has a high dye-forming efficiency in the color development step, the photographic properties of which are not influenced by the deviation of pH of a color developing bath, and which is excellent in retaining good color balance of color images after storage of the photographic material.

BACKGROUND OF THE INVENTION

As magenta color image-forming couplers (hereinafter referred to more simply as "magenta couplers"), various pyrazolone derivatives are known. However, these pyrazolone derivative couplers show low coloring efficiency (conversion efficiency of the coupler into a dye) when they are used for color photographic materials. Particularly, in a so-called four-equivalent coupler having no substituent at the coupling position, the coupler forms a dye to an extent of only about ½ mole of dye per mole of coupler.

As a coupler for improving the coloring efficiency, a so-called two-equivalent coupler, e.g., a pyrazolone type magenta coupler having a substituent introduced at the coupling active position thereof, with the substituent being split off (released) in a color development step, is known. Examples of such couplers are described in U.S. Pat. Nos. 3,311,476, 3,419,391, 3,617,291, 3,926,631, etc.

Also, magenta couplers having a substituent connected through a sulfur atom to the coupling active position of the coupler are known. Examples include couplers having a thiocyano group as described in U.S. Pat. No. 3,214,437; couplers having an acrylthio group or a thioacrylthio group as described in U.S. Pat. No. 4,032,346; couplers having an arylthio group or a heterocyclic thio group as described in U.S. Pat. Nos. 3,227,554, and 3,701,783; and further as described in Japanese Patent Publication No. 34,044/'78; and couplers having an alkylthio group as described in West German Patent Application (OLS) No. 2,944,601. Also Japanese Patent Application (OPI) No. 57,239/'84 describes a pyrazolone coupler having a substituted alkylthio group of a specific chemical structure as a releasable group (the term "OPI" indicates an unexamined Japanese patent application open to public inspection) and Japanese Patent Application (OPI) No. 57,240/'84 describes a specific magenta coupler having a releasable group which blocks sulfur atom in the alkylthio group by an intramolecular nucleophilic reaction after a coupling reaction However, the present inventors have found that when a coupler having an arylthio group at the coupling active position thereof in the magenta couplers as described in U.S. Pat. Nos. 3,227,554 and 3,701,783 is used for a color photographic material and color images are formed, the images thus formed are insufficient in storability. In other words, when color images formed using the above-described color photographic material are stored for a long period of time, the color images are insufficient with respect to resisting change in densities; discoloring and fading by the action of light, heat, humidity, etc.; change of balance of the three colors, yellow, magenta, and cyan; and the occurrence of staining in non-colored portions.

Furthermore, it has also been found that when the magenta coupler having an arylthio group as a releasable group described in aforesaid Japanese Patent Application (OPI) No. 34,044/'78 is used for color photographic material and color images are formed using the color photographic material, the color images formed are insufficient in storability as in the above-described case.

Moreover, it can be said that the magenta coupler having an arylthio group as the releasable group described in Japanese Patent Application (OPI) No. 35,858/'82 is a significant coupler in the point of overcoming the problem of light fastness among the abovedescribed various difficulties of the conventional magenta couplers, but the color photographic materials using these magenta couplers still leave room for improvement with respect to the change in color balance after fading and the formation of stain.

Also, the conventional magenta couplers having an arylthio group as the releasable group as described above encounter the problem that the coloring property is reduced in the case of processing the color photographic materials containing the couplers with a color developer containing a salt of an alkaline earth metal such as calcium, magnesium, etc. This becomes a fatal defect in the case of preparing the processing liquid using water containing a large amount of alkaline earth metal salts, i.e., hard water. Further, in color developing laboratories around the world, it is rare to be able to use soft water for the processing liquid, and hard water is usually employed as the water for the processing liquid.

Accordingly, color photographic materials containing conventionally known magenta couplers having an arylthio group as a releasing group can be developed only in definite developing laboratories using no hard water, although the coulers have some characteristics.

SUMMARY OF THE INVENTION

This invention is based on the discovery of excellent properties provided by certain combinations of cyan and magenta couplers as set forth hereinafter. For instances, the magenta couplers which are used for the color photographic materials of this invention have the feature that the change in color balance of the color images during the storage thereof is less, the formation of stain is restrained, and the coloring property is not reduced even in the case of using a processing solution using hard water, together with the merits such as those of the above-described known magenta couplers having an arylthio group as the releasable group as described in Japanese Patent Publication No. 35,858/'82. The excellent properties of the color photographic materials of this invention as described above have never been expected based on other color photographic materials containing the aforesaid conventional magenta couplers having an arylthio group as the releasable group.

Thus, the present invention overcomes the above described difficulties in the conventional color photographic materials.

A first object of this invention therefore, is, to provide a color photographic material capable of providing color photographic images having good coloring properties and being excellent in color reproducibility even in a developer prepared using hard water containing alkaline earth metal ions.

A second object of this invention, is to provide a color photographic material capable of providing the above-described color images the non-image portions which of are not stained even when the color images are exposed to heat, humidity or light for a long period of time.

A third object of this invention is to provide a color photographic material capable of providing color photographic images the image portions of which show less fading in the whole density regions and show no deviation of color balance.

A fourth object of this invention is to provide a color photographic material capable of providing color images having more improved stability to heat, humidity, and light by containing various additives.

That is, according to this invention, there is provided a color photographic material comprising a support having thereon (i) a silver halide emulsion layer containing a compound represented by formula (I) or (II) and, (ii) a silver halide emulsion layer containing a 5-pyrazolone coupler for photography having an arylthio group at the coupling position thereof, wherein said arylthio group includes an aliphatic oxy group or an aromatic oxy group at an ortho-position with respect to the sulfur atom of the arylthio group, and said aliphatic oxy group or the aromatic oxy group being unsubstituted or substituted by at least one member selected from (a) a halogen atom, (b) a cyano group, (c) an aliphatic, aromatic, or heterocyclic sulfonyl, sulfinyl, or phosphonyl group, which may further have a substitutent, (d) a group represented by the formula $$-A_1-\underset{\underset{O}{\|}}{C}-B_1$$

wherein $A_1$ represents a single bond, an oxygen atom, a sulfur atom, an imino group, a divalent aliphatic group, a divalent aromatic group or a divalent heterocyclic group and $B_1$ represents a hydroxy group, an aliphatic oxy group, an aromatic oxy group, a hydrogen atom, an aliphatic group, an aromatic group, a heterocyclic group, an unsubstituted or substituted noncyclic amino group, or an unsubstituted or substituted hydrazino group, and (e) a group represented by the formula $$-(A_2-M)_nB_2$$

wherein $A_2$ represents a single bond, a divalent aliphatic group, a divalent aromatic group, or a divalent heterocyclic group; $B_2$ represents a hydrogen atom, an aliphatic group, an aromatic group, or heterocyclic group; M represents an oxygen atom, a sulfur atom, or an imino group; and n represents an integer of 1 to 4.

Formula (I) and (II) are are represented by

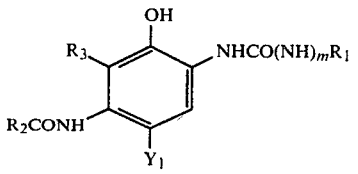

(I)

and

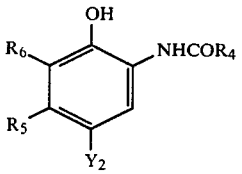

(II)

wherein $R_1$, $R_2$ and $R_4$ each represents an unsubstituted or substituted aliphatic group, an unsubstituted or substituted aromatic group, or an unsubstituted or substituted heterocyclic group; $R_3$ and $R_6$ each represents a hydrogen atom, a halogen atom, an aliphatic group, or an acylamino group; or $R_2$ and $R_3$ together represent a non-metallic atomic group forming a nitrogen-containing 5- or 6-membered ring; $R_5$ represents an unsubstituted or substituted aliphatic group having at least 2 carbon atoms; $Y_1$ and $Y_2$ each represents a hydrogen atom or a group capable of being released during the oxidative coupling reaction with a developing agent; and m represents 0 or 1; and said coupler may form a dimer or higher oligomer coupler by linking through a group of the groups represented by $R_2$, $R_3$, and $Y_1$ or in the groups represented by $R_5$, $R_6$, and $Y_2$.

In the present invention an aliphatic group may be straight, branched or cyclic and it may be a saturated or unsaturated group such as an alkyl group, alkenyl group and alkynyl group.

Of course, the use of combinations of compounds represented by formula (I) or (II) and/or the use of combinations of the 5pyrazlone couplers is also within the scope of the present invention.

DESCRIPTION OF THE PREFERRED EMBODIMENT

The cyan couplers represented by above-described formulae (I) and (II) are explained in more detail.

In formulae (I) and (II), the aliphatic groups represented by $R_1$, $R_2$, and $R_4$ is preferably an aliphatic group having from 1 to 32 carbon atoms, such as a methyl group, a butyl group, a tridecyl group, a cyclohexyl group, an allyl group, etc. The aryl group shown by $R_1$, $R_2$, and $R_4$ preferably has from 6 to 20 carbon atoms. Examples of aryl group include a phenyl group, a naphthyl group, etc. The heterocyclic group is preferably a 5- to 7-membered heterocyclic group containing at least one of O, S, and N as a hetero atom. Examples of heterocyclic group include a 2-pyridyl group, a 2-imidazolyl group, a 2-furyl group, a 6-quinolyl group, benzothiazolyl group, etc. These groups described above may be further substituted by an alkyl group, an aryl group, heterocyclic group (as described above), an alkoxy group (e.g., a methoxy group, 2-methoxyethoxy group, etc.), an unsubstituted or substituted aryloxy group, examples for substituent include an alkyl group, an aryl group, an aralkyl group, an alkoxy group, a halogen atom, —CN, —OH, etc., (examples for the aryloxy group include a 2,4-di-tert-amylphenoxy group, 2-chlorophenoxy group, 4-cyanophenoxy group, etc.), alkenyloxy group (e.g., a 2-propenyloxy group, etc.), an aliphatic or aromatic acyl group (e.g., an acetyl group, benzyl group, etc.), an ester group (e.g., a butoxy-carbonyl group, phenoxycarbonyl group, acetoxy group, benzoyloxy group, butoxysulfonyl group, toluenesulfonyloxy group, etc.), an aliphatic or aromatic amido group (e.g., an acetylamino group, methane-sulfonamide group, dipropyl-sulfamoylamino group, etc.), an aliphatic or aromatic carbamoyl group (e.g., a dimethylcarbamoyl group, ethyl-carbamoyl group, etc.), an aliphatic or aromatic sulfamoyl group (e.g., a butylsulfamoyl group), an aliphatic or aromatic imido group (e.g., a succinimido group, hydantoinyl group, etc.), an aliphatic or aromatic ureido group (e.g., a phenylureido group, dimethylureido group, etc.), an aliphatic or aromatic sulfonyl group (e.g., a methanesulfonyl group, phenylsulfonyl group, etc.), an unsubstituted or substituted aliphatic or aromatic thio group (e.g., an ethylthio group, a phenylthio group), a hydroxy group, a cyano group, a carboxy group, a nitro group, a sulfo group, a halogen atom, etc. Carbon numbers in the aliphatic and aromatic hydrocarbon moieties in these substitutents are from 1 to 20 and 6 to 20, respectively.

The aliphatic group represented by $R_3$ or $R_6$ preferably has from 1 to 4 carbon atoms. The acylamino group represented by $R_3$ or $R_6$ is an aliphatic acylamino group preferably having from 2 to 5 carbon atoms or an aromatic acylamino group preferably having from 7 to 11 carbon atoms. When $R_3$ is a group having a substituent, the substituent may be one as described above in regard to $R_1$.

Examples of the aliphatic groups represented by $R_3$ and $R_6$ each include methyl, ethyl and propyl.

$R_5$ in formula (II) is preferably an alkyl group having from 2 to 15 carbon atoms or a methyl group having a substituent containing one or more carbon atoms. Preferred examples of the substituent for the methyl group are an arylthio group, an alkylthio group, an acylamino group, an aryloxy group, and an alkoxy group.

$R_5$ may be substituted as described above, and examples of the aliphatic group are an ethyl group, a propyl group, a butyl group, a pentadecyl group a tert-butyl group, a cyclohexyl group, a cyclohexylmethyl group, a phenylthiomethyl group, a dodecyloxyphenylthio methyl group, a butan amidomethyl group, a methoxymethyl group, etc.

In formula (I) and formula (II) described above, $Y_1$ and $Y_2$ each represents a hydrogen atom or a coupling releasable group (including a coupling releasable atom, and so forth) and examples thereof are a halogen atom (e.g., a fluorine atom, chlorine atom, bromine atom, etc.) an unsubstituted or substituted alkoxy group (e.g., an ethoxy group, dodecyloxy group methoxyethylcarbamoylmethoxy group, carboxypropyloxy group, methylsulfonylethoxy group, etc.), an unsubstituted or substituted aryloxy group (e.g., a 4-chlorophenoxy group, 4-methoxyphenoxy group, 4-carboxyphenoxy group, etc.), an unsubstituted or substituted aliphatic or aromatic acyloxy group (e.g., an acetoxy group, tetradecanoyloxy group, benzyloxy group, etc., a sulfonyloxy group (e.g., a methanesulfonyloxy group, toluenesulfonyloxy group, etc.), an unsubstituted or substituted aliphatic or aromatic amido group (e.g., a dichloroacetylamino group, heptafluorobutyrylamino group, methanesulfonylamino group, toluenesulfonylamino group, etc.), an unsubstituted or substituted alkoxycarbonyloxy group (e.g., an ethoxycarbonyloxy group, benzyloxycarbonyloxy group, etc.), an unsubstituted or substituted aryloxycarbonyloxy group (e.g., a phenoxycarbonyloxy group, etc.), an unsubstituted or substituted aliphatic aromatic thio group or heterscyclic thio group (e.g., an ethylthio group, phenylthio group, tetrazolylthio group, etc.), an unsubstituted or substituted aliphatic or aromatic imido group (e.g., a succinimido group, hydantoinyl group, etc.), an unsubstituted or substituted aromatic azo group (e.g., a phenylazo group, etc.). The aliphatic and aromatic hydrocarbon moieties in these groups preferably have from 1 to 22 and from 6 to 22 carbon atoms, respectively. These releasable groups may constitute a photographically useful group derived from, for example, a development restrainer or accelerator.

Preferred examples of the cyan couplers represented by formulae (I) and (II) above are described as follows.

$R_1$ in formula (I) is preferably an aryl group or a heterocyclic group, and is more preferably an aryl group substituted by a halogen atom, an alkyl group, an alkoxy group, an aryloxy group, an acylamino group, an acyl group, a carbamoyl group, a sulfonamido group, a sulfamoyl group, a sulfonyl group, a sulfamido group ($-NHSO_2NH_2$), an oxycarbonyl group, or a cyano group.

When $R_3$ and $R_2$ in formula (I) do not form a ring, $R_2$ is preferably an unsubstituted or substituted alkyl group or an unsubstituted or substituted aryl group, particularly preferably an alkyl group substituted by a substituted aryloxy group. $R_3$ is preferably a hydrogen atom.

In formula (I), $R_4$ is preferably an unsubstituted or substituted alkyl group having from 1 to 20 carbon atoms or an unsubstituted or substituted aryl group having from 6 to 20 carbon atoms, and more preferably an alkyl group substituted by a substituted aryloxy group.

$R_5$ in formula (II) is more preferably an alkyl group having from 2 to 15 carbon atoms, and most preferably an alkyl group having from 2 to 4 carbon atoms.

$R_6$ in formula (II) is preferably a hydrogen atom or a halogen atom, and particularly preferably a chlorine atom and a fluorine atom.

$Y_1$ and $Y_2$ in formulae (I) and (II) are preferably a hydrogen atom, a halogen atom, an alkoxy group, an aryloxy group, an acyloxy group, or a sulfonamide group.

$Y_2$ in formula (II) is preferably a halogen atom, and particularly preferably a chlorine atom or a fluorine atom.

When m is 0 in formula (I) described above, $Y_1$ is more preferably a halogen atom, and particularly preferably a chlorine atom or a fluorine atom.

Specific examples of the cyan couplers represented by formulae (I) and (II) described above are illustrated below, but the invention is not limited to such couplers.

(C-1)
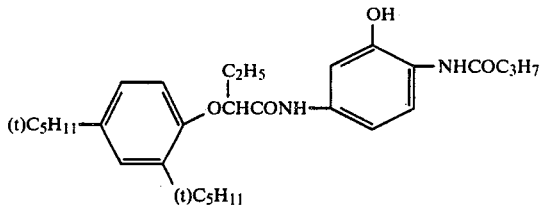
(C-2)
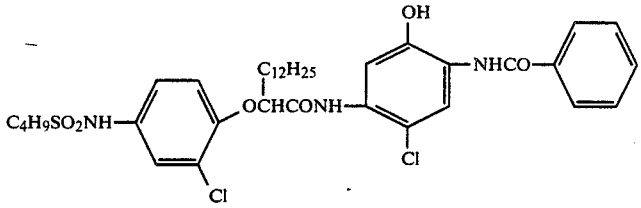
(C-3)
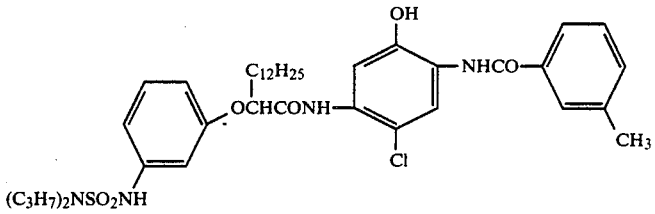
(C-4)
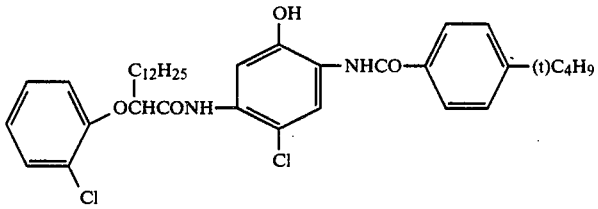
(C-5)
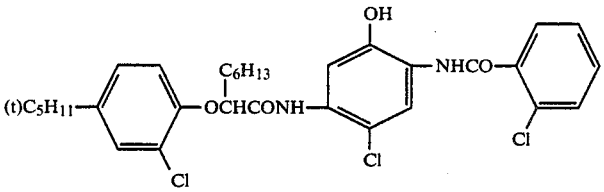
(C-6)
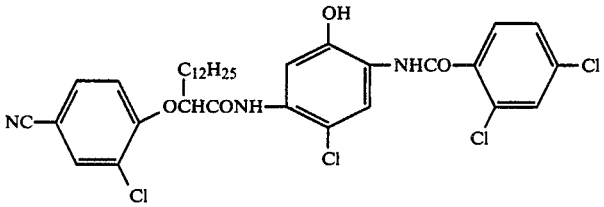
(C-7)
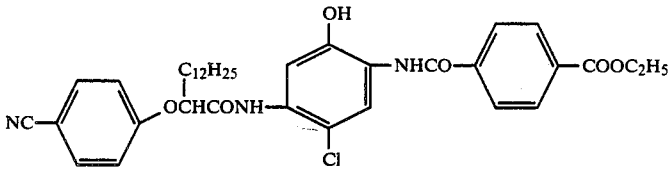
(C-8)
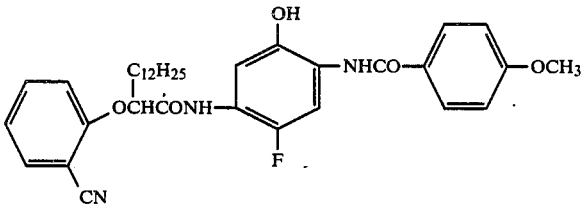

-continued
(C-9)
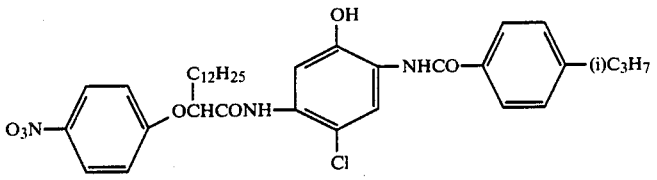
(C-10)
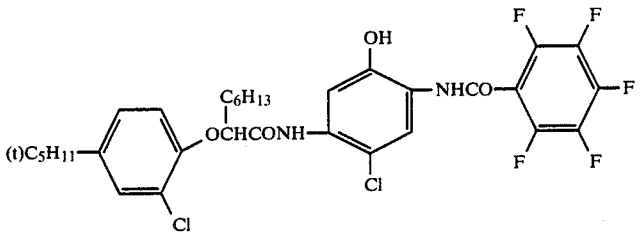
(C-11)
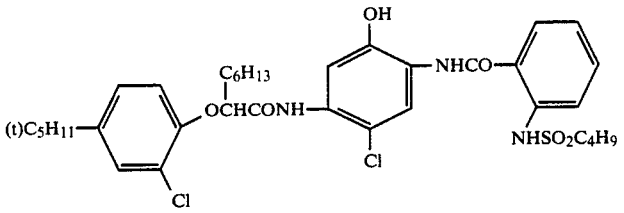
(C-12)
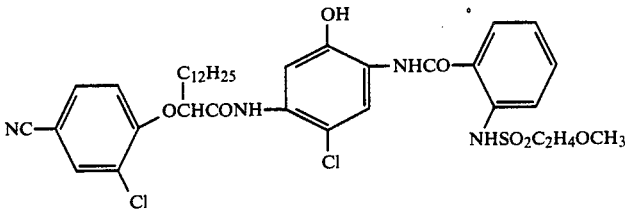
(C-13)
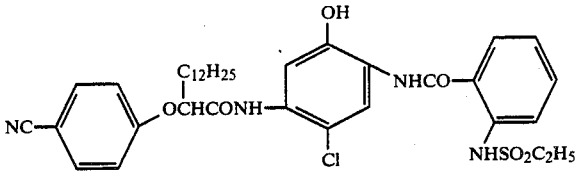
(C-14)
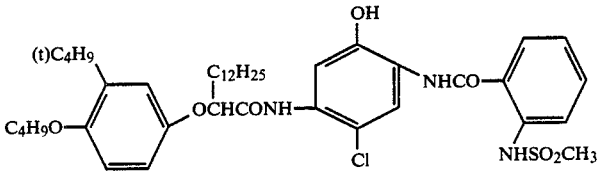
(C-15)
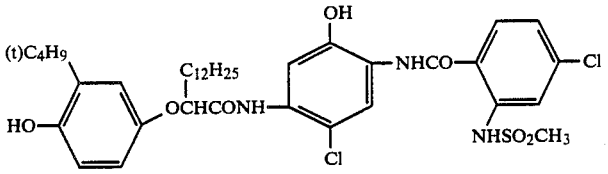
(C-16)
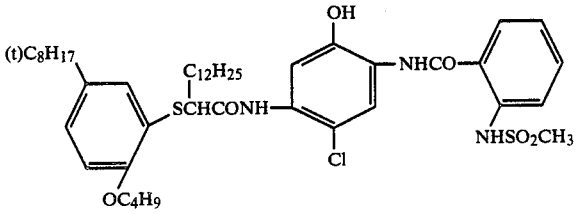

-continued
(C-17)
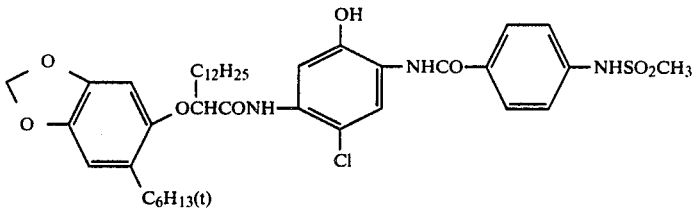
(C-18)
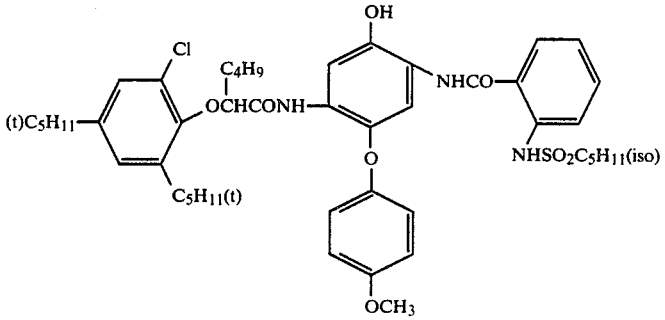
(C-19)
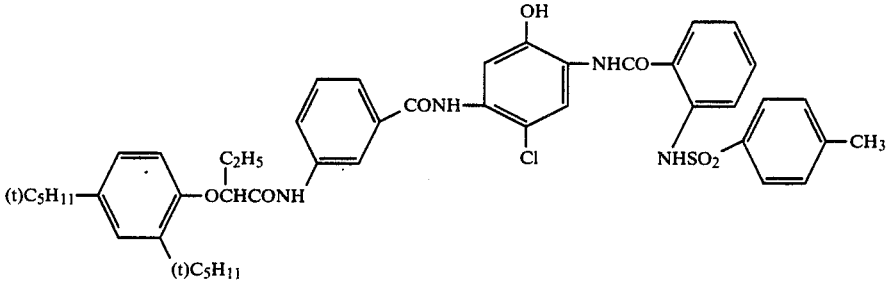
(C-20)
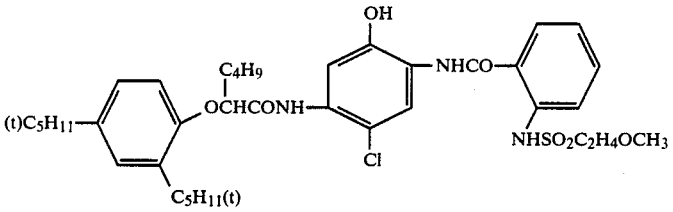
(C-21)
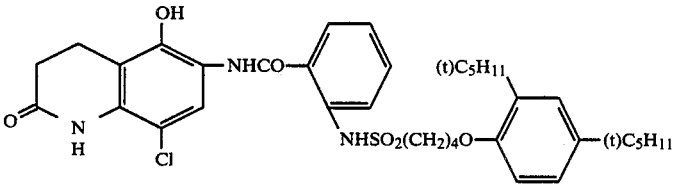
(C-22)
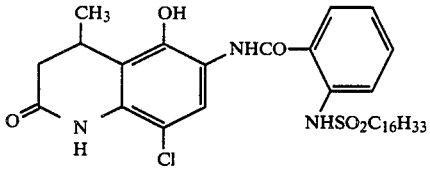
(C-23)
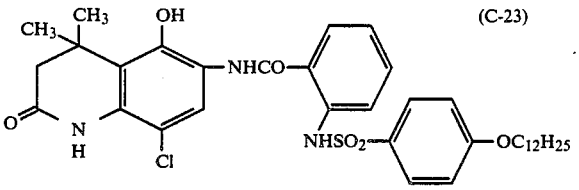
(C-24)
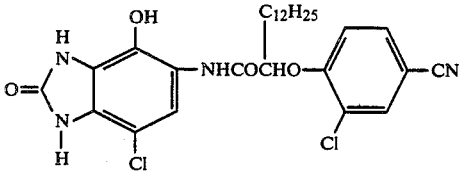
(C-25)
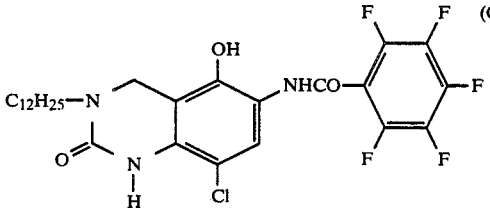

-continued
(C-26)
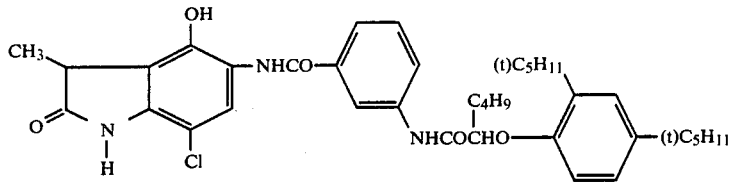
(C-27)
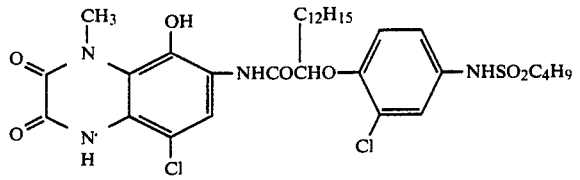
(C-28)
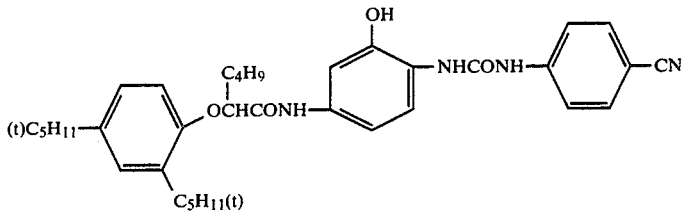
(C-29)
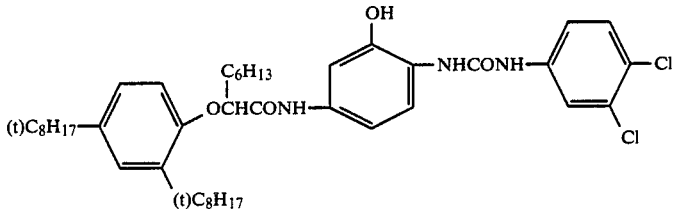
(C-30)
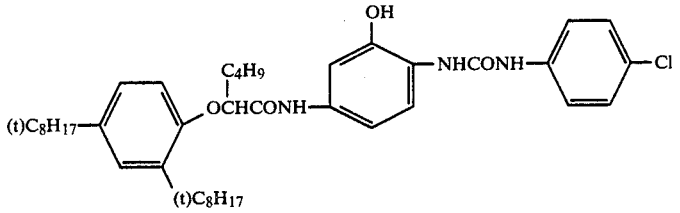
(C-31)
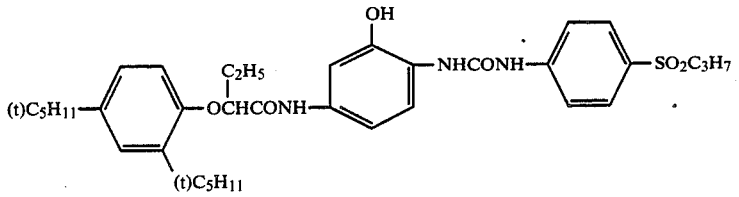
(C-32)
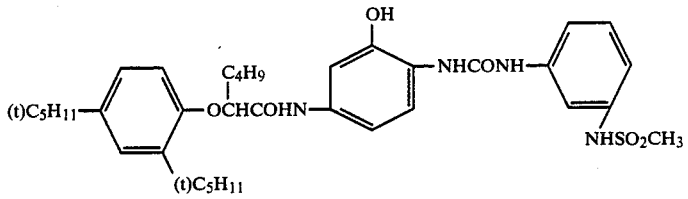
(C-33)
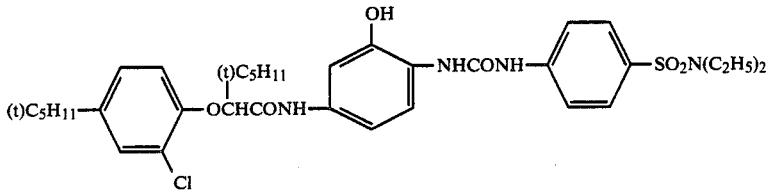

-continued
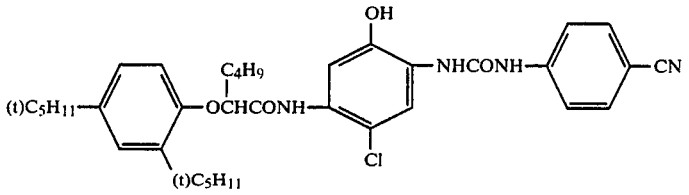
(C-34)
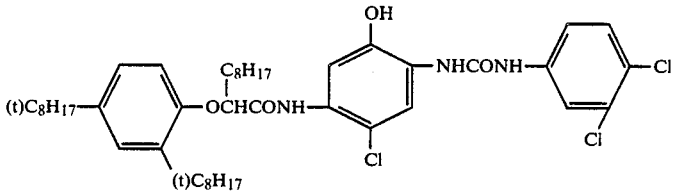
(C-35)
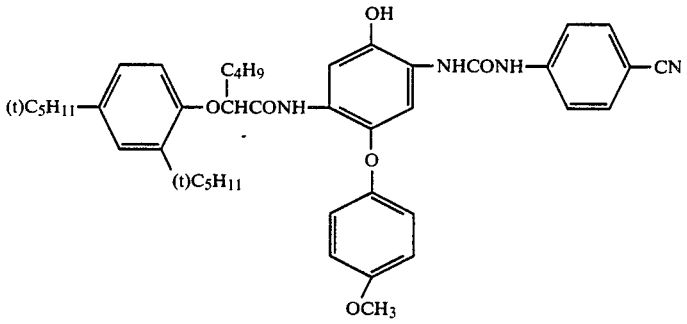
(C-36)
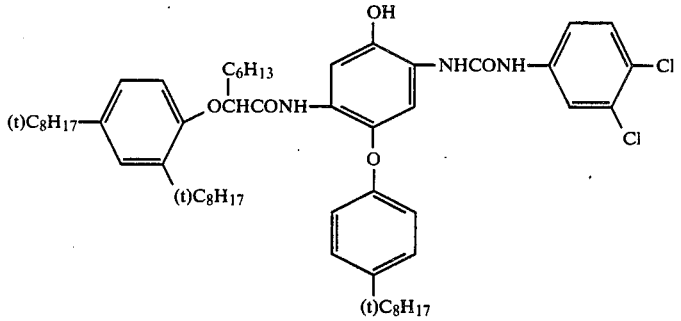
(C-37)
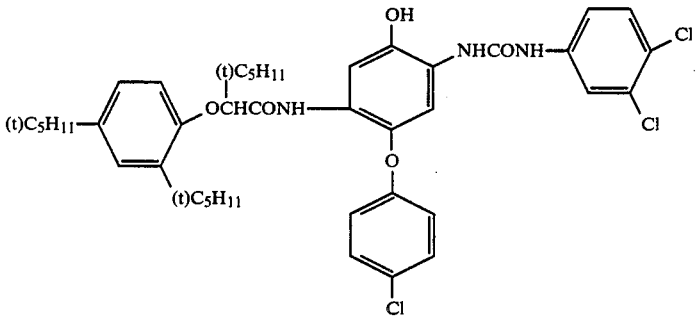
(C-38)
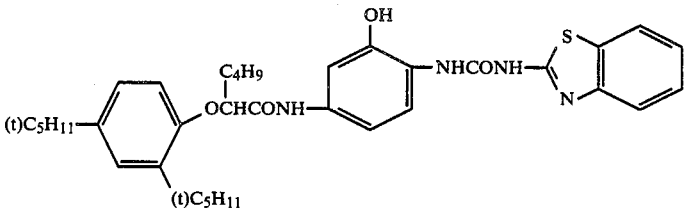
(C-39)

-continued
(C-40)
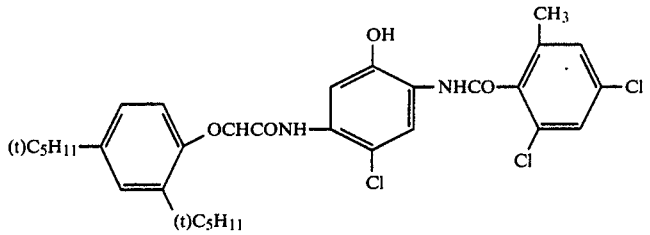
(C-41)
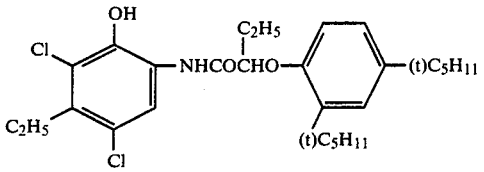
(C-42)
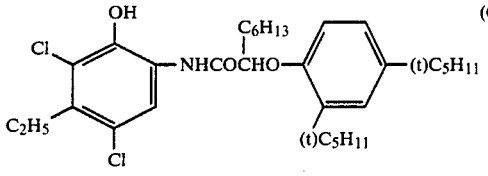
(C-43)
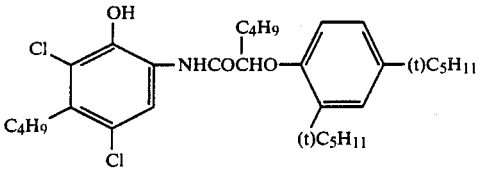
(C-44)
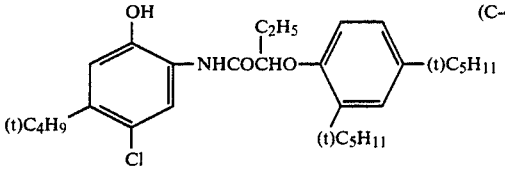
(C-45)
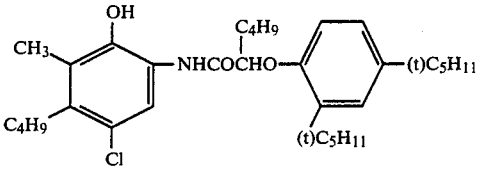
(C-46)
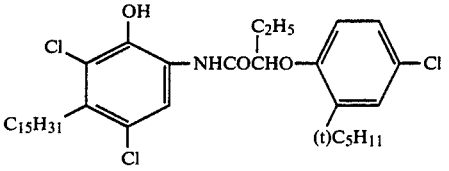
(C-47)
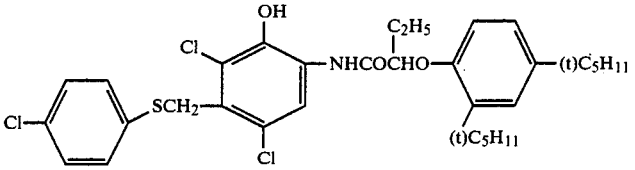
(C-48)
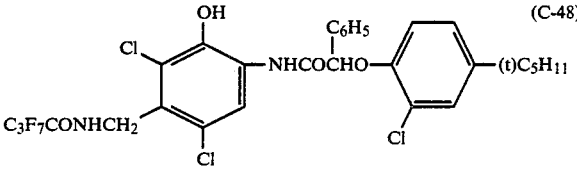
(C-49)
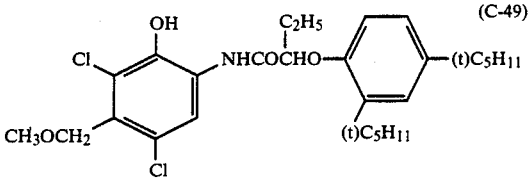
(C-50)
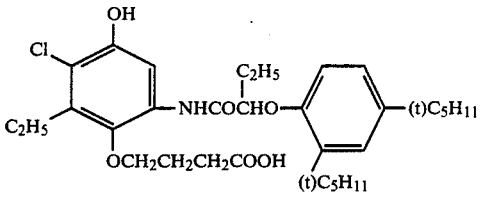
(C-51)
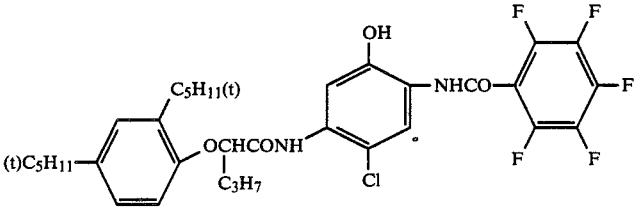

-continued
(C-52)
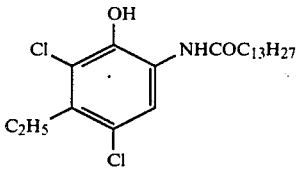
(C-53)
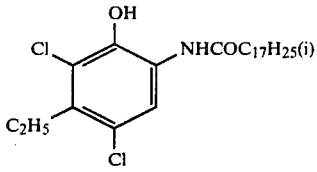
(C-54)
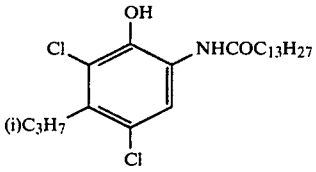
(C-55)
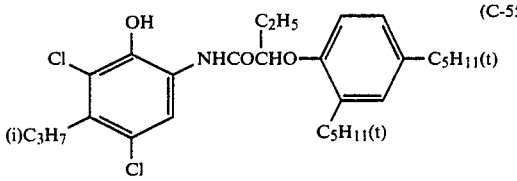
(C-56)
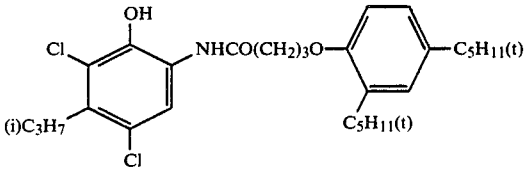
(C-57)
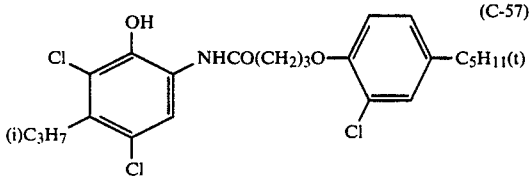
(C-58)
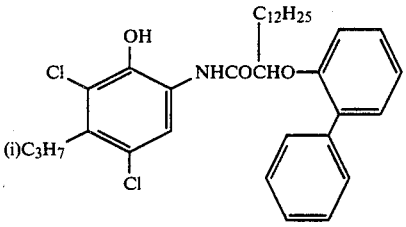
(C-59)
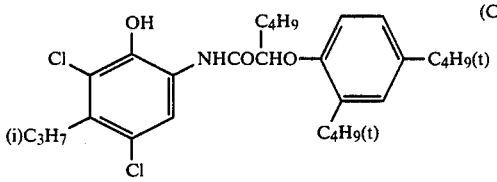
(C-60)
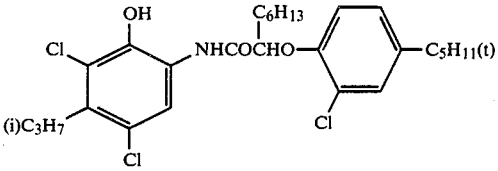
(C-61)
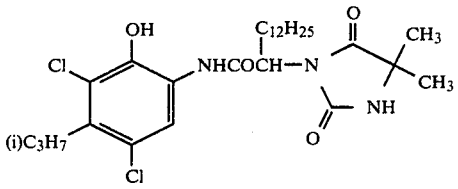
(C-62)
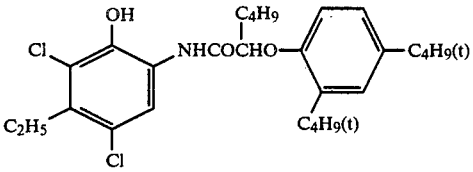
(C-63)
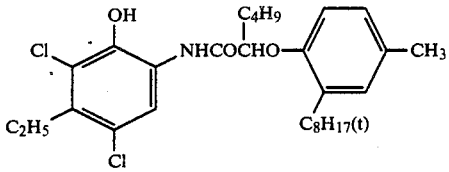
(C-64)
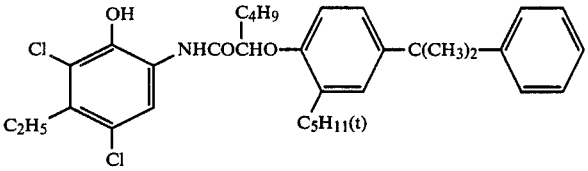
(C-65)
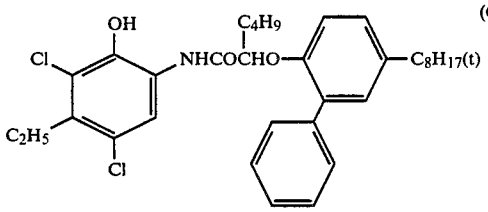
(C-66)
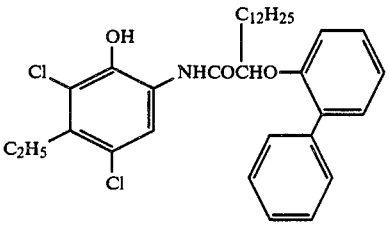
(C-67)
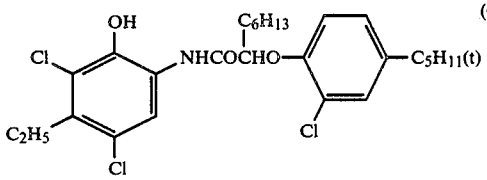

-continued (C-68)

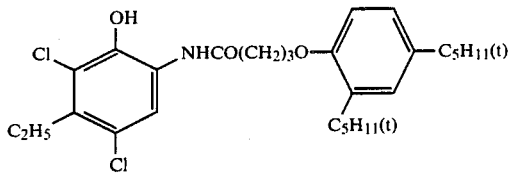

(C-69)

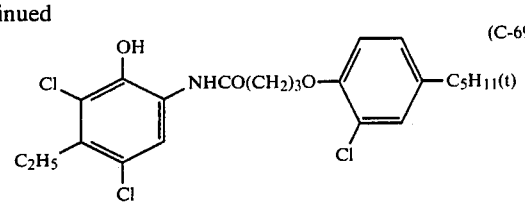

(C-70)

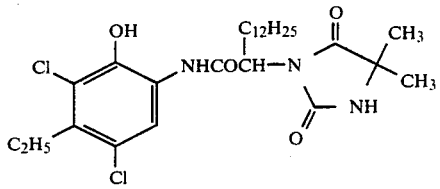

(C-71)

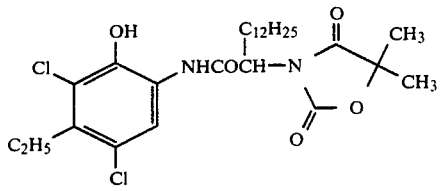

Magenta couplers for use in this invention include, for example, the magenta couplers represented by formula (III)

(III)

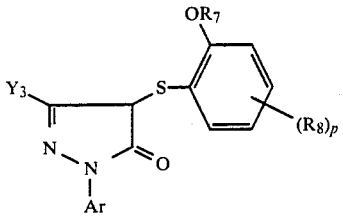

wherein Ar represents a phenyl group substituted by from 1 to 5 halogen atoms, alkyl groups, alkoxy groups, alkoxycarbonyl groups, or cyano groups, which preferably having from 1 to 20 carbon atoms in the hydrocarbon moieties thereof; $R_7$ represents an unsubstituted or substituted aliphatic group or an aromatic group which may be substituted by (a) a halogen atom, (b) a cyano group, (c) an aliphatic, aromatic or heterocyclic sulfonyl, sulfinyl or phosphonyl groups, (d)

$$-A_1-\underset{\underset{O}{\|}}{C}-B_1,$$

or (e) $-(A_2-M)_2B_2$; $A_1$, $B_1$, $A_2$, M, $B_2$, and n have the same significance as defined above; $R_8$ represents a hydrogen atom, a halogen atom, a hydroxy groups, an alkyl group, an alkoxy group, an aryl group, an aliphatic or aromatic amino group, an aliphatic or aromatic acylamino group, an aliphatic or aromatic ureido group, an alkoxycarbonylamino group, an aliphatic or aromatic imido group, an aliphatic or aromatic sulfonamido group, an aliphatic or aromatic sulfamoyl group, an aliphatic or aromatic sulfamoylamino group, a nitro group, an alkoxycarbonyl group, an aliphatic or aromatic carbamoyl group, an aliphatic or aromatic acyl group, a cyano group or an alkylthio group; $Y_3$ represents an aliphatic or aromatic acylamino group or an anilino group; and p represents an integer of 1 to 4; and when p is more than 2, said $R_8$ may be the same or different. These groups may be substituted.

The magenta coupler represented by formula (III) wherein the aliphatic group or aromatic group represented by $R_7$ substituted by at least one substituents (a) to (e) is preferably used in this invention.

Also, the magenta coupler of formula (III) can exist in a bis-form by the connection at $R_7$ and $R_8$.

Of the magenta couplers represented by formula (III) described above, preferred couplers are represented by formula (IV)

(IV)

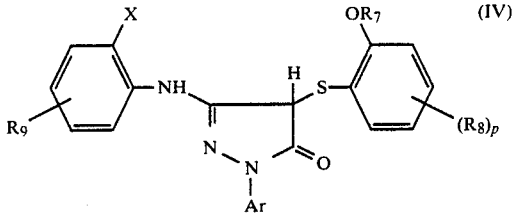

wherein $R_7$, $R_8$, Ar, and p have the same meanings as defined for formula (III); X represents a halogen atom or an alkoxy group; and $R_9$ represent a hydrogen atom, a halogen atom, an alkyl group, an alkoxy group, an acylamino group, a sulfonamido group, a sulfamoyl gorup, a carbamoyl group, a diacylamino group, an alkoxycarbonyl group, an alkoxysulfonyl group, an aryloxysulfonyl group, an alkanesulfonyl group, an arylsulfonyl group, an alkylthio group, an arylthio group, an alkyloxycarbonylamino group, an alkylureido group, an acyl group, a nitro group, a carboxy group, or a trichloromethyl group.

Ar of formulae (III) and (IV) represents a substituted phenyl group, and examples of the substituent include a halogen atom (e.g., a chlorine atom, bromine atom, fluorine atom, etc.), an alkyl group having from 1 to 22 carbon atoms (e.g., a methyl group, ethyl group, tetradecyl group, t-butyl group, etc.), an alkoxy group having from 1 to 22 carbon toms (e.g., a methoxy group, ethoxy group, octyloxy group, dodecyloxy group, etc.), an alkoxycabonyl group having from 2 to 23 carbon atoms (e.g., a methoxycarbonyl group, ethoxycarbonyl group, tetradecyloxycarbonyl group, etc.), or a cyano group.

X in formula (IV) represents a halogen atom (e.g., a chlorine atom, bromine atom, fluorine atom, etc.) or an alkoxy group having from 1 to 22 carbon atoms (e.g., a methoxy group, octyloxy group, dodecyloxy group, etc.).

$R_9$ in formula (IV) represents a hydrogen atom, a halogen atom (e.g., a chlorine atom, bromine atom, fluorine atom, etc.), an alkyl group (such as straight or branched chain alkyl group, aralkyl group, alkenyl group, cycloalkyl group, and cycloalkenyl group, for example, a t-butyl group, a t-octyl group, a tetradecyl group, a benzyl group, an allyl group, a cyclopentyl group, a cyclohexenyl group, etc.), an alkoxy group (e.g., a methoxy group, ethoxy group, 2-ethylhexyloxy group, tetradecyloxy group, etc.), an acylamino group (e.g., an acetamido group, benzamido group, butanamido group, tetradecanamido group, α-(2,4-di-tert-amylphenoxy)acetamido group, α-(2,4-di-tert-amylphenoxy)butylamido group, α-(3-pentadecylphenoxy)hexanamido group, α-(4-hydroxy-3-tert-butylphenoxy)-tetradecanamido group, 2-oxopyrrolidin-1-yl group, 2-oxo-5-tetradecylpyrrolidin-1-yl group, N-methyl-tetradecanamido group, etc.), a sulfonamido group (e.g., a methanesulfonamido group, benzenesulfonamido group, p-toluenesulfonamido group, octanesulfonamido group, p-dodecylbenzenesulfonamido group, N-methyl-tetradecane-sulfonamido group, etc.), a sulfamoyl group (e.g., an N-methylsulfamoyl group, N-hexadecylsulfamoyl group, N-[3-(dodecyloxy)-propyl]sulfamoyl group, N-[4-(2,4-di-tert-amylphenoxy)butyl]sulfamoyl group, N-methyl-N-tetradecyl-sulfamoyl group, etc.), a carbamoyl group (e.g., an N-methylcarbamoyl group, N-octadecylcarbamoyl group, N-[4-(2,4-di-tert-amylphenoxy)butyl]carbamoyl group, N-methyl-N-tetradecylcarbamoyl group, etc.), a diacylamino group (e.g., an N-succinimido group, N-phthalimido group, 2,5-dioxo-1-oxazolydinyl group, 3-dodecyl-2,5-dioxo-1-hydantoinyl group, 3-(N-acetyl-N-dodecylamino)succinimido group, etc.), an alkoxycarbonyl group (e.g., a methoxycarbonyl group, tetradecyloxycarbonyl group, benzyloxycarbonyl group, etc.), an alkoxysulfonyl group (e.g., a methoxysulfonyl group, octyloxysulfonyl group, tetradecyloxysulfonyl group, etc.), an aryloxysulfonyl group (e.g., a phenoxysulfonyl group, 2,4-di-tert-amylphenoxysulfonyl group, etc.), an alkanesulfonyl group (e.g., a methanesulfonyl group, octanesulfonyl group, 2-ethylhexanesulfonyl group, hexadecanesulfonyl group, etc.), an arylsulfonyl group (e.g., a benzenesulfonyl group, 4-nonylbenzenesulfonyl group, etc.), an alkylthio group (e.g., an ethylthio group, hexylthio group, benzylthio group, tetradecylthio group, 2-(2,4-di-tert-amylphenoxy)ethylthio group, etc.), an arylthio group (e.g., phenylthio group, p-tolylthio group, etc.), an alkyloxycarbonylamino group (e.g., an ethyloxy-carbonylamino group, benzyloxycarbonylamino group, hexadecyloxycarbonylamino group, etc.), an alkylureido group (e.g., an N-methylureido group, N,N-dimethylureido group, N-methyl-N-dodecylureido group, N-hexadecyluredito group, N,N-dioctadecylureido group, etc.), an acyl group (e.g., an acetyl group, benzoyl group, octadecanoyl group, p-dodecanamidobenzoyl group, etc.), a nitro group, a carboxy group, or a trichloromethyl group. In this case, however, the alkyl group or moiety in the above-described groups has from 1 to 36 carbon atoms and the aryl group or moiety in the above groups has from 6 to 38 carbon atoms.

The details of the halogen atom, alkyl group, alkoxy group, acylamino group, ureido group, alkoxycarbonylamino group, imido group (same as diacylamino group), sulfonamido group, sulfamoyl group, alkoxycarbonyl group, carbamoyl group and alkylthio group represented by $R_8$ in formula (IV) shown above are the same as those described above in detail for $R_9$.

$R_8$ further represents, in addition to the above-described groups, a hydrogen atom, a hydroxy group, an aryl group (e.g., phenyl group, α- or β-naphthyl group, 2-chlorophenyl group, 4-acetamidophenyl group, 4-t-butylphenyl group, 4-cyanophenyl group, etc.), an amino group (e.g., an N-alkylamino group such as N-(2-methoxyethyl)amino group, N-(2-methanesulfonylethyl)amino group, N-(3-acetamidopropyl)amino group, etc.; an N,N-dialkylamino group such as an N,N-dibutylamino group, N,N-dihexylamino group, N,N-bis(2-ethylhexylamino group, N,N-bis(2-hexanesulfonylethylamino) group, N-ethyl-N-dodecylamino group, N,N-bis(3-phenoxypropylamino) group, N-ethyl-N-[2-(2,4-di-tert-amyphenoxy)-ethylamino] group, N,N-bis{2-[(4-tert-butylphenoxy)acetamido]-ethyl} group, etc.; an anilino group such as phenylamino group, 4-methoxyphenylamino group, N-ethylphenylamino group, 2,4-di-tert-phenylamino group, 3-methanesulfonamidophenylamino group, 2-chlorophenylamino group, etc.), or a sulfamoylamino group such as N,N-dibutylsulfamoylamino group, N-ethyl-N-dodecylsulfamoylamino group, N-ethyl-N-anilinosulfamoylamino group, N,N-bis(2-butanesulfonyl-ethyl)-sulfamoylamino group, etc.), a nitro group, an acyl group (e.g., an acetyl group, benzoyl group, hexanoyl group, 2,4-di-tert-butylbenzoyl group, 2-hydroxybenzoyl group, decyloxyacetyl group, etc.), or a cyano group.

That is, $R_7$ in formula (IV) is preferably an alkyl group or an aryl group each having a substituent such as a cyano group, a halogen atom,

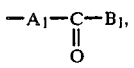

$-(A_2-M)_nB_2$, a sulfonyl group, sulfinyl group, or a phosphonyl group (wherein, $A_1$, $B_1$, $A_2$, M, $B_2$ and n have the same significance as defined above), and is more preferably an alkyl group or an aryl group having a substituent selected from

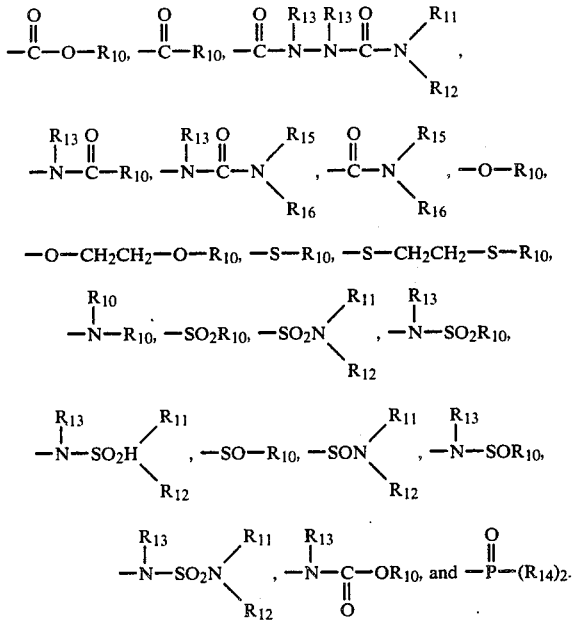

In the above formulae, $R_{10}$ represents a hydrogen atom, an alkyl group, an aryl group, or a heterocyclic group preferably having at least one of O, N, and S as a hetero atom and which is 5- to 7-membered ring; $R_{11}$ and $R_{12}$ each represents a hydrogen atom, an alkyl gropu, an aryl group, a heterocyclic group (as explained for $R_{10}$), or $R_{11}$ and $R_{12}$ represent groups which may combine with each other to form a 5-membered, 6-membered, or 7-membered nitrogen-containing heterocyclic ring; $R_{13}$ represents a hydrogen atom or an alkyl group; $R_{14}$ represents an alkyl group, an alkoxy group, an aryl group, an aryloxy group, an aryl group, a heterocyclic group; and the alkyl grop and the aryl group shown by $R_{10}$ to $R_{16}$ may have a suubstituent as described for $R_8$ and $R_9$, and they preferably have from 1 to 20 carbon atoms in the alkyl group or moiety and from 6 to 20 in the aryl group or moiety.

Particularly preferred $R_7$ is an alkyl group having as a substituent an ether group, carbonyl group, sulfonyl group or phosphonium group described above in detail.

Hereinafter, specific examples of the magenta couplers used in this invention are illustrated, but the invention is not limited to such couplers.

(M-1)

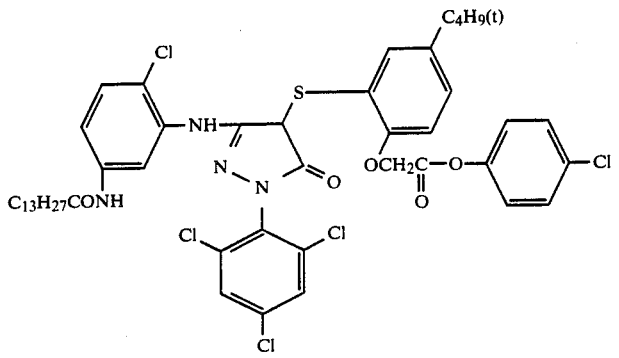

(M-2)

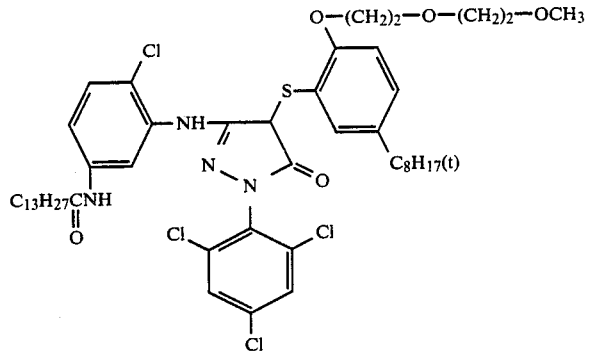

(M-3)

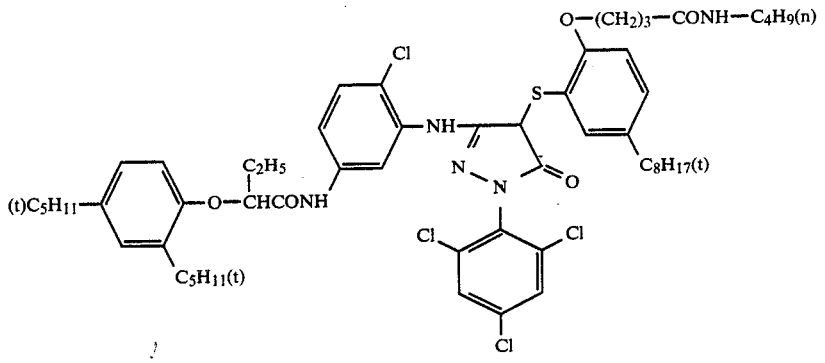

(M-4)

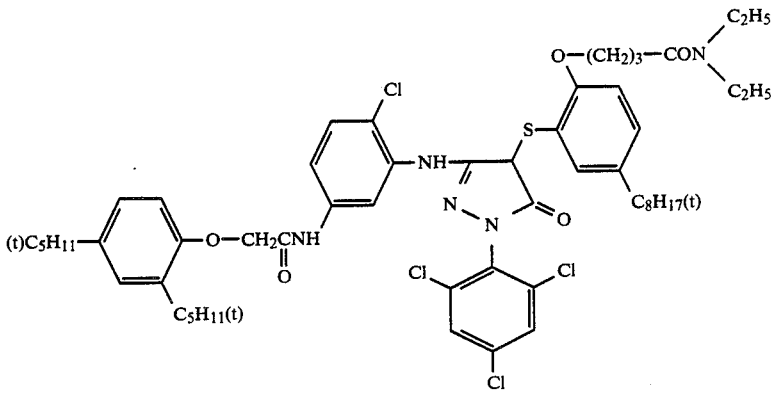

-continued
(M-5)
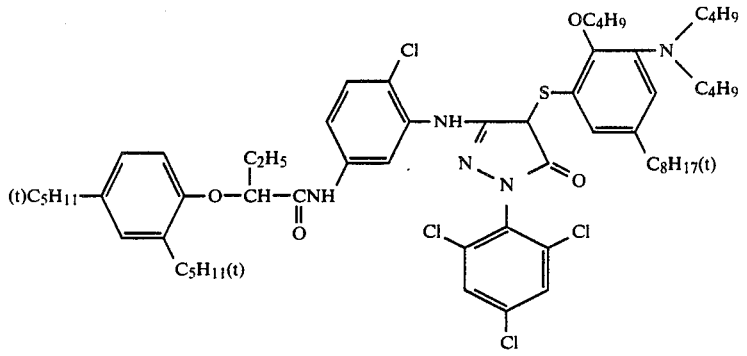
(M-6)
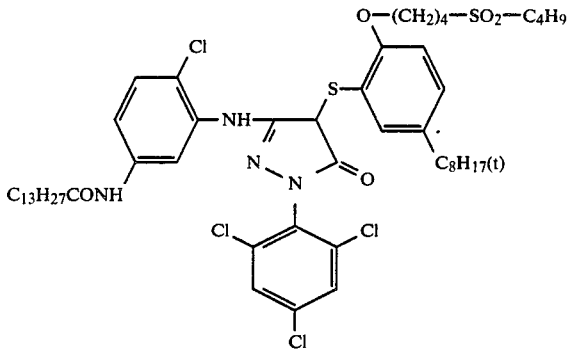
(M-7)
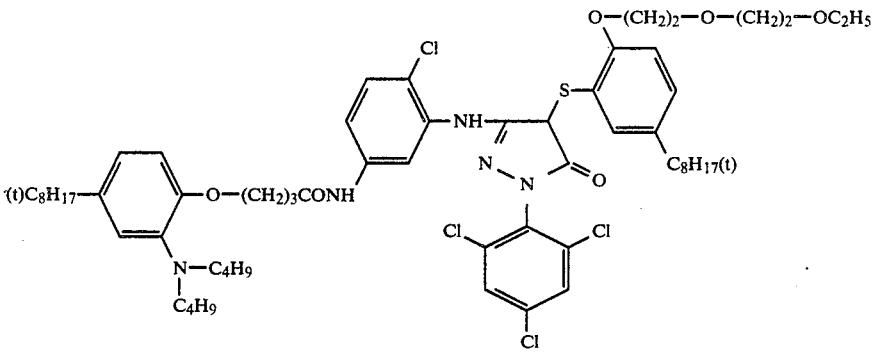
(M-8)
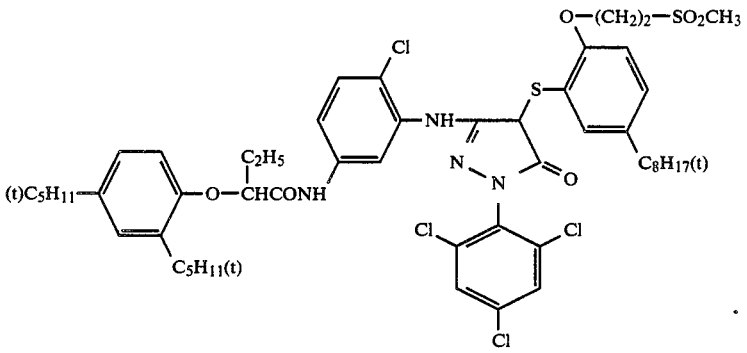

-continued
(M-9)
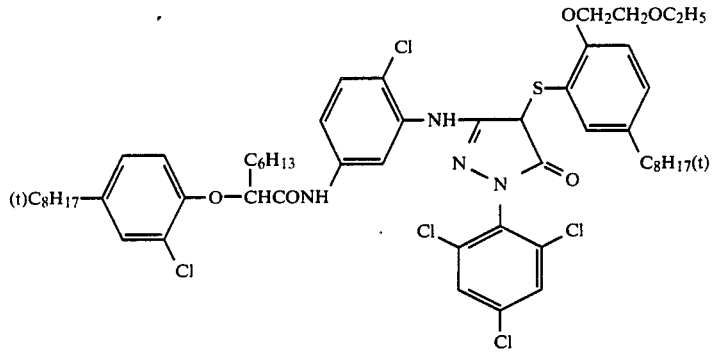
(M-10)
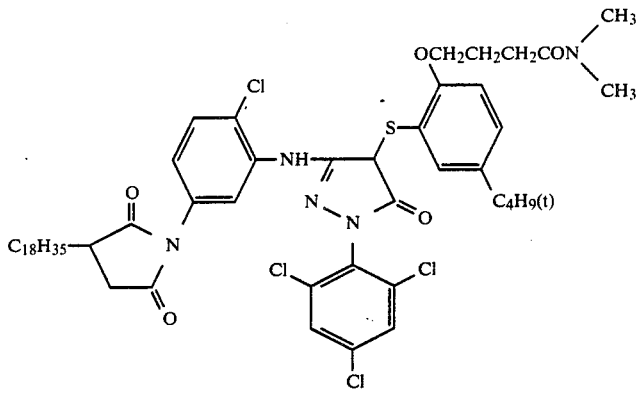
(M-11)
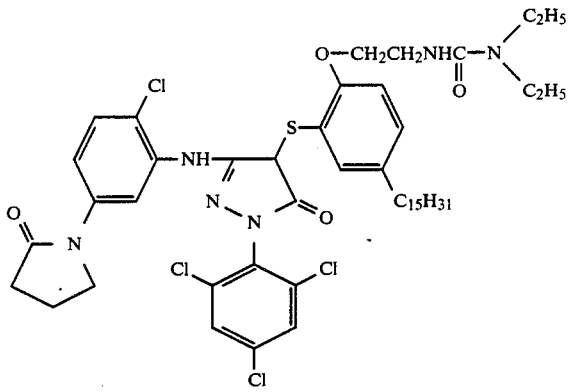
(M-12)
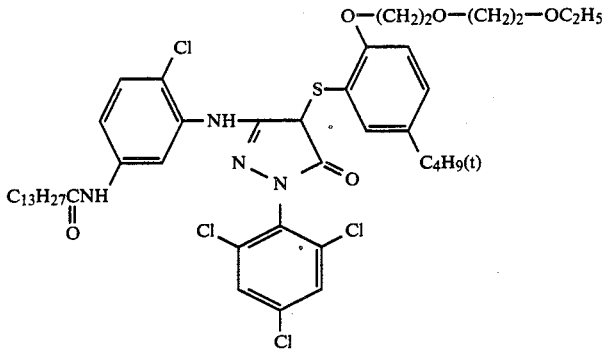

-continued
(M-13)
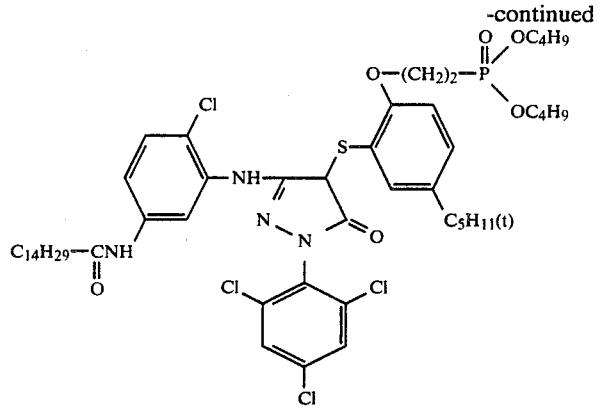
(M-14)
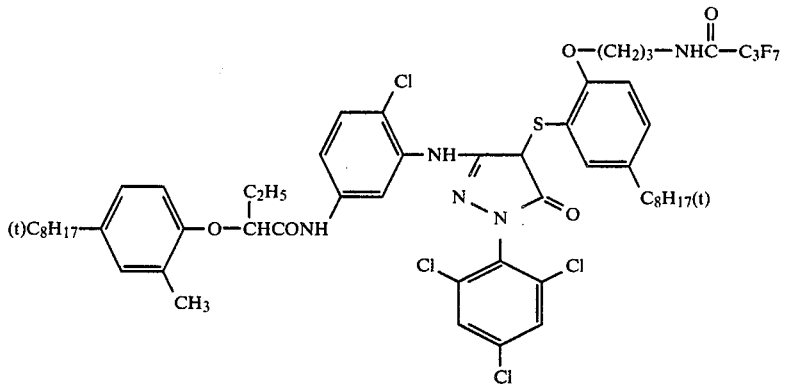
(M-15)
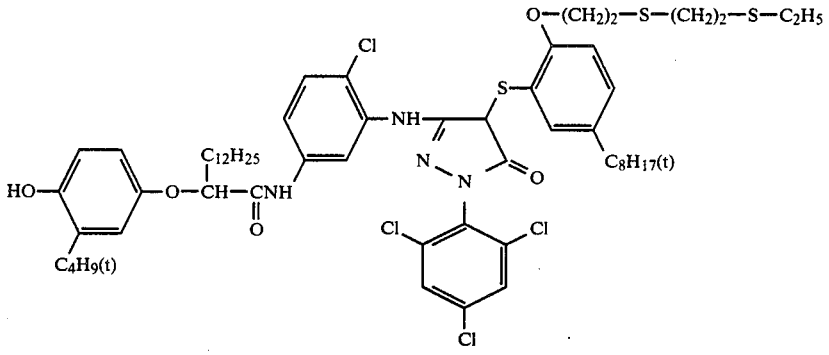
(M-16)
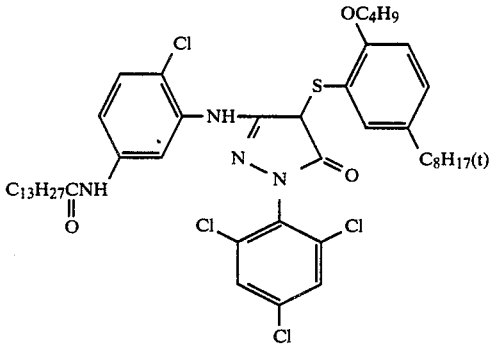
There is no particular restriction on yellow color image-forming couplers (hereinafter referred to simply as yellow couplers) in this invention, and any conventionally known yellow couplers can be used in this invention.
For example, yellow couplers represented by formula (V) can be preferably used in this invention.
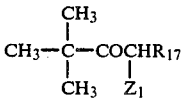
(V)

In formula (V), $R_{17}$ represents an unsubstituted or substituted N-phenylcarbamoyl group and $Z_1$ represents a hydrogen atom or a group capable of releasing at the coupling reaction with the oxidation product of a developing agent; said coupler may form a dimer or higher oligomer by boding at $Z_1$.

In formula (V), the substituent for the phenyl group of the N-phenylcarbamoyl group shown by $R_{17}$ can be optionally selected from the group of the substitutents described above on $R_1$, and when there are two or more substituents, they may be the same or different.

Preferably $R_{17}$ is a group represented by formula (Va)

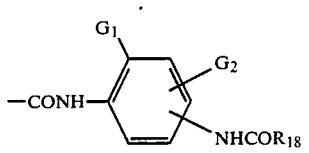

(Va)

wherein $G_1$ represents a halogen atom or an alkoxy group; $G_2$ represents a hydrogen atom, a halogen atom, or an alkoxy group which may have a substituent; and $R_{18}$ represents an alkyl group which may have a substituent.

Examples of the substituent for $G_2$ and $R_{18}$ in general formula (Va) include an alkyl group, an alkoxy group, an aryl group, an aryloxy group, an amino group, a dialkylamino group, a heterocyclic group (e.g., N-morpholino group, N-piperidino group, 2-furyl group, etc.), a halogen atom, a nitro group, a hydroxy group, a carboxy group, a sulfo group, an alkoxycarbonyl group, etc.

The above-described couplers which can be used in this invention and other couplers which can also be used in this invention are further described in the following publications together with synthesis methods for them.

For example, cyan couplers are described in U.S. Pat. Nos. 2,772,162 and 4,333,999, Japanese Patent Application (OPI) No. 98,731/'83, Japanese Patent Publication No. 11,572/'74, etc.; magenta couplers are described in Japanese Patent Application (OPI) Nos. 35,858/'82, 2,953/'85, 23,855/'85, etc.; yellow couplers are described in Japanese Patent Application (OPI) No. 48,541/'79, Japanese Patent Publication No. 10,739/'83; U.S. Pat. No. 4,326,024, *Research Disclosure,* RD No. 18053, etc. The couplers used in the examples of this invention described hereinafter can be prepared by the synthesis methods described in the above publications.

Also, the highly coloring ballast groups described, for example, in Japanese Patent Application (OPI) Nos. 42,045/'83, 214,854/'84, 177,553/'84, 177,554/'84, 177,557/'84, etc., can be employed for the above-described couplers in this invention.

Each of cyane and magenta couplers is incorporated in each silver halide emlsion layer, respectively, in an amount of from $2\times10^3$ to $5\times10^1$ mole, and preferably from $1\times10^{-2}$ to $5\times10^1$ mole, per mole of the silver halide in the emulsion layer. Also, the molar ratio of the cyan coupler/the magenta coupler for use in this invention is in the range of 1/about 0.2 to 1.5, but ratios other than above can be also employed in this invention. When a cyan coupler other than those defined in (i) and a magenta coupler other than those defined in (ii) are used, they may be used in an amount of from 0.2 to 1.5 moles per mole of each coupler defined in (i) and (ii).

For incorporating the above-described couplers in silver halide photographic emulsion layers, known various techniques can be used in this invention. For example, the coupler can usually be added to a silver halide emulsion by an oil drop in water type dispersing method. That is, the coupler is dissolved in a high-boiling organic solvent or a low-boiling organic solvent.and then the solution is dispersed in an aqueous gelatin solution containing a surface active agent. Or, water or an aqueous gelatin solution is added to an organic solvent solution of the copler containing a surface active agent and an oil drop in water type dispersion may be prepared by utilizing a phase inversion. Furthermore, when the couler is an alkali-soluble coupler, the couler can be dispersed by a so-called Fischer dispersing method. Also, after removing the low-boiling organic solvent from the cupler dispersion by distillation, noodle washing, or ultrafiltration, the dispersion of the coupler may be mixed with a silver halide photographic emulsion.

In more detail, for introducing the yellow copler, the magenta coupler, or the cyan coupler into a silver halide emulsion layer of the color photographic material of this invention, a high-boiling organic solvent having a boiling point of higher than 160° C., such as a phthalic acid alkyl ester (e.g., dibutyl phthalate, dioctyl phthalate, etc.), a phosphoric acid ester (e.g., diphenyl phosphate, triphenyl phosphate, tricresyl phosphate, dioctylbutyl phosphate, etc.), a citric acid ester (e.g., tributyl acetylcitrate, etc.), a benzoic acid ester (e.g., octyl benzoate, etc.), an alkylamide (e.g., diethyllaurylamide, etc.), a fatty acid ester (e.g., dibutoxyethyl succinate, dioctyl azelate, etc.), a phenol (e.g., 2,4-di-t-amylphenol, etc.), etc., or a low-boiling organic solvent having a boiling point of 30° to 150° C., such as a lower alkyl acetate (e.g., butyl acetate), ethyl propionate, secondary butyl alcohol, methyl isobutyl ketone, $\beta$-ethoxyethyl acetate, methyl cellosolve acetate, etc., can be used solely or as a mixture thereof. The phthalic acid alkyl esters and the phosphoric acid esters are preferably used in this invention.

A color photographic material sometimes causes a so-called stain, i.e., a color density at the unexposed areas thereof during development or during the storage thereof after development. This stain reduces the whiteness of the background portion of the color images and also causes color turbidity at the image portions, which results in reducing the visual sharpness of the images. Various additives have been investigated for preventing the occurrence of stain, but the effective additives are classified into antioxidants and amines.

As the antioxidant which can be used for the above-described purpose, there are hydroquinones, aminophenols, gallic acid derivatives, ascorbic acid derivatives, spiroindan derivatives, 3-pyrazolone derivatives, etc., are effective and preferably hydroquinones and spiroindane derivatives are used solely or as a mixture thereof.

Also, amines are effectively used for preventing the occurrence of stain or color turbidity as described above and can be used solely or, preferably, together with the aforesaid antioxidants. Preferred amines are the N-substituted anilines described, for example, in Japanese Patent Application (OPI) No. 105,147/'83; the steric hindrance cyclic tertiary amines described, for example, in Japanese Patent Application (OPI) No. 102,231/'83; N-substituted aminotriazines described, for example, in Japanese Patent Application (OPI) No. 218,445/'84, and the tertiary alkylamines described, for example, in Japanese Patent Application (OPI) No. 229,559/'84.

The amines reduce the activity by forming salts with pyrazolone type couplers in a neutral state. Also, the antioxidants control or reduce the formation of stain under dark heat and light exposure since they prevent the occurrence of the air oxidation of couplers or leuco dyes.

The antioxidant is used in an amount of from 0.2 to 2 moles, and preferably from 0.7 to 1.3 moles, per mole of the coupler and the amine is used in an amount of from 0.8 to 2.0 moles, and preferably from 1.1 to 1.6 moles, per mole of the coupler. It is preferred that the antioxidant or the amine is emulsified together with coupler. In some cases, the amines and the antioxidants may be used in place of the high-boiling organic solvent.

The use of the magenta coupler for use in this invention together with an amine, in particular, the N-substituted aniline described in Japanese Patent Application (OPI) No. 105,147/'83 can reduce the occurrence of yellow stain in the case of storing the color print under light exposure, (hereinafter referred to as light stain) as well as having a particularly remarkable effect for the reduction of light fading of magenta color images. Also, the N-substituted aniline is effective for restraining the formation of yellow stain in the case of storing color prints under the condition of high-temperature and/or high humidity.

The color photographic materials of this invention may further contain specific couplers in addition to the yellow couplers, magenta couplers, and cyan couplers represented by the above-described formulae. For example, a colored magenta coupler may be incorporated in a green-sensitive silver halide emulsion layer to impart a masking effect to the emulsion layer. Also, development inhibitor releasing couplers (DIR couplers) or development inhibitor releasing hydroquinones can be used for color-sensitive emulsion layers or layers adjacent to these color-sensitive emulsion layers. The development inhibitor released from these compounds with the progress of the development gives an interlayer multilayer effect such as improvement of the sharpness of images, improvement of the grain fineness of images, and improvement of the monochromatic saturation.

In the color photographic material of this invention, a coupler capable of releasing a development accelerator or a nucleating agent with silver development can be incorporated in the silver halide photographic emulsion layer or a layer adjacent to the emulsion layer for improving the photographic sensitivity, improving the grainness of color images, and increasing the contrast of gradation.

In this invention, a ultraviolet absorbent may be incorporated in any desired layer of the color photographic material, but is preferably incorporated in the silver halide emulsion layer containing the compound represented by above-described formula (I) or (II) or a layer adjacent to the emulsion layer.

Ultraviolet absorbents which can be used in this invention are described, for example, in *Research Disclosure,* RD No. 17643, VIII-C. In these compounds, the benzotriazole derivatives represented by formula (VI) are preferred.

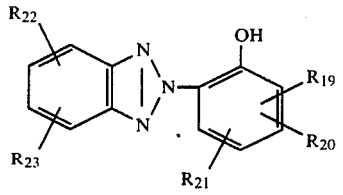

(VI)

In formula (VI), $R_{19}$, $R_{20}$, $R_{21}$, $R_{22}$, and $R_{23}$, which may be the same or different, each represents a hydrogen atom or a group described hereinbefore as a substituent for the aromatic group shown by $R_1$ or $R_4$ in formula (I) or (II) above; and said $R_{22}$ and $R_{23}$ can together form a 5- or 6-membered aromatic carbon ring. The groups described above may be further substituted by substituents as described for $R_1$ or $R_4$ in formula (I) or (II).

The ultraviolet absorbents represented by formula (VI) may be used singly or as a mixture thereof.

Specific examples of the ultraviolet absorbent which can be used in this invention are illustrated below.

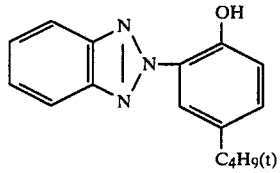

(UV-1)

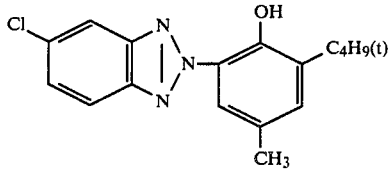

(UV-2)

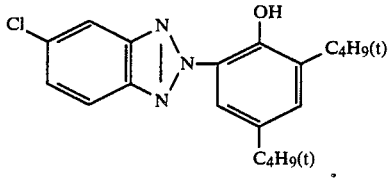

(UV-3)

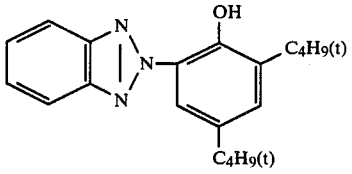

(UV-4)

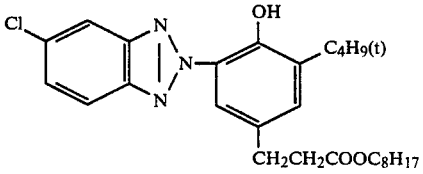

(UV-5)

-continued (UV-6)

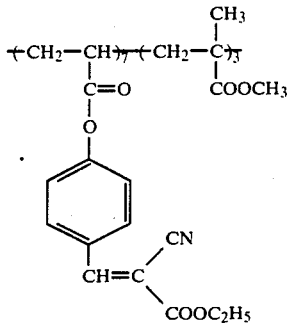

Synthesis methods for the compounds represented by formula (VI) and examples of other ultraviolet absorbents which can also be used in this invention are described, for example, in Japanese Patent Publication No. 29,620/'69; Japanese Patent Application (OPI) Nos. 151,149/'75, 95,233/'79; U.S. Pat. No. 3,766,205; European Patent No. 57,160; *Research Disclosure,* RD No. 22519 (1983, Vol. No. 255), etc. Also, the polymeric ultraviolet absorbents described in Japanese Patent Application (OPI) Nos. 111,942/'83, 178,351/'83, 181,041/'83, 19,945/'84, 23,344/'84, etc., can be used in this invention and a specific example thereof is shown above as UV-6. A low molecular weight ultraviolet absorbent and a polymeric ultraviolet absorbent may be used together.

The above-described ultraviolet absorbent is dissolved in a high-boiling organic solvent and/or a low-boiling organic solvent as in the case of the foregoing coupler and then is dispersed in an aqueous solution of a hydrophilic colloid. There is no particular restriction on the amounts of the high-boiling organic solvent and the ultraviolet absorbent, but usually, a high-boiling organic solvent is used in the range of from 0 to 300 weight % based on the weight of the ultraviolet absorbent. A ultraviolet absorbent which is in a liquid state at normal temperature is preferably used individually or in combination.

When the ultraviolet absorbent shown by formula (VI) described above is used together with the combination of the couplers of this invention described above, the storability, and in particular, the color fastness to light of color images, (most particularly cyan images) can be improved. The ultraviolet absorbent may be emulsified together with the cyan coupler.

The amount of the ultraviolet absorbent should be sufficient for imparting light stability to a cyan dye image, but if the amount is too large, the unexposed areas (white portions) of the color photographic material are sometimes yellowed. Thus, the amount of the ultraviolet absorbent is preferably from $1\times10^{-4}$ mole/m$^2$ to $2\times10^{-3}$ mole/m$^2$, and more preferably from $5\times10^{-4}$ mole/m$^2$ to $1.5\times10^{-3}$ mole/m$^2$.

In an ordinary layer constitution of a color photographic paper, the ultraviolet absorbent is usually incorporated in one layer, preferably two layers adjacent to one side or both sides of a red-sensitive silver halide emulsion layer containing a cyan coupler. When the ultraviolet absorbent is incorporated in a interlayer between a green-sensitive emulsion layer and a red-sensitive emulsion layer, the ultraviolet absorbent may be emulsified together with a color mixing preventing agent. When the ultraviolet absorbent is incorporated in a protective layer, another protective layer may be formed on the protective layer as the outermost layer. The outermost protective layer may contain a matting agent having a desired particle sizes.

For improving the storability of colored dye images, and in particular yellow dye images and magenta dye images, various organic or metal complex-type fading preventing agents may be used together therewith. As such organic fading prevent agent, hydroquinones, gallic acid derivatives, p-alkoxyphenols, p-oxyphenol, etc., may be used. Dye image stabilizers, stain preventing agents, and antioxidants which can be used in this invention are described in the patents cited in *Research Disclosure,* RD No. 17643, VII, Chapters I and J.

Also, metal complex-type fading preventing agents are described in *Research Disclosure,* RD No. 15162, etc.

For improving the fastness of yellow dye images to heat and light, phenols, hydroquinones, hydroxychroman, hydroxycoumarans, hindered amines, and the alkylethers, silylethers, or hydrolyzable precursor derivatives thereof can be used.

The addition amount of the fading preventing agent for yellow dye images depends upon the nature of the yellow coupler used together with the fading agent but is usually in the range of from 0.5 to 200% by weight, preferably in the range of from 2 to 150% by weight with respect to the yellow coupler. Preferably, the fading agent is emulsified together with the yellow coupler.

In the color photographic materials of this invention, preferred fading preventing agents for magenta dye images are described, for example, in U.S. Pat. Nos. 3,336,135, 3,432,300, 3,573,050, 3,574,627, 3,700,455, 3,764,337, 3,935,016, 3,982,944, 4,254,216, and 4,279,990; U.K. Patent Nos. 1,347,556, 2,062,888, 2,066,975, and 2,077,455; Japanese Patent Application No. 205,278/'83; Japanese Patent Application (OPI) Nos. 152,225/'77, 17,729/'78, 20,327/'78, 145,530/'79, 6321/'80, 21,004/'80, 24,141/'83, and 10,539/'84; Japanese Patent Publication Nos. 31,625/'73, 12,337/'79, etc. These fading preventing agents can greatly improve color fastness to light.

The amount of the aforesaid fading preventing agent is generally from 1 to 200 mole%, and preferably from 5 to 100 mole%, with respect to the amount of magenta coupler used. It is preferred that the fading preventing agent be emulsified together with the magenta coupler.

For fading prevention, a technique of covering a dye image with an oxygen shielding layer composed of a material having a low oxygen permeability is described, for example, in Japanese Patent Application (OPI) Nos. 11,330/'74 and 57,223/'75 and also a technique for forming a layer having an oxygen permeability of less than 20 ml/m$^2$.hr.atom at the support side of a dye image-forming layer of a color photographic material is described in Japanese Patent Application (OPI) No. 85,747/'81. These techniques can be applied for this invention.

For silver halide emulsion layers of the color photographic materials of this invention, various kinds of silver halides can be used. For example, silver chloride, silver bromide, silver chlorobromide, silver iodobromide, and silver chloroiodobromide can be used. Silver iodobromide containing from 2 to 20 mole% silver iodide and silver chlorobromide containing from 10 to 50 mole% silver bromide are preferably used in this invention.

There are no particular restrictions about the crystal form, crystal structure, grain sizes, grain size distribution, etc., of silver halide grains for use in this invention. The crystal form of the silver halide may be a regular crystal form or twin form. Furthermore, the crystal form may be a hexahedron, an octahedron, or a tetradecahedron. Furthermore, tabular silver halide grains having a thickness of less than 0.5 micron, a diameter of at least 0.6 micron, and a mean aspect ratio of higher than 5/1, as described in *Research Disclosure,* RD No. 22534 can be used in this invention.

The crystal structure of silver halide may be uniform throughout the crystals or may differ in formation between the inside and the outside of the crystal, may form a layer structure, may be composed of silver halide crystals having different formation connected with each other by an epitaxial connection, or may be a mixture of silver halide crystals of various different crystal forms. Moreover, the silver halide crystal grains may be mainly forming latent image at the surface of the grains, or may be mainly forming latent image inside of the grains.

The grain size of silver halide may be 0.1 microns or less, or may be a large grain size such as up to 3 microns of a projection area diameter. Furthermore, the emulsion may be a monodisperse emulsion of silver halide having a narrow distribution of grain size or may be a multidisperse emulsion of silver halide having a wide distribution of grain size.

The silver halide grains can be produced by known methods conventionally employed in art.

The above-described silver halide emulsions for use in this invention can be sensitized by an ordinary chemical sensitization, i.e., a sulfur sensitization, noble metal sensitization or a combination thereof. Furthermore, the silver halide emulsions for use in this invention can be sensitized to a desired light-sensitive wavelength region using sensitizing dyes. As dyes which are advantageously used in this invention, there are methine dyes and styryl dyes such as cyanine dyes, hemicyanine dyes, rhodacyanine dyes, merocyanine dyes, oxonole dyes, hemioxonole dyes, etc., as is explained below in more detail. They can be used singly or as a combination of two or more dyes.

Support for use in this invention include transparent supports such as polyethylene terephthalate films and cellulose triacetate films and reflection supports as described below. Reflection supports are preferred in this invention, and include baryta-coated papers, polyethylene-coated papers, polypropylene-series synthetic papers, and transparent supports such as glass plates, polyester films (e.g., polyethylene terephthalate films, etc.), cellulose acetate films, cellulose nitrate films, polyamide films, polycarbonate films, polystyrene films, etc., each laminated with a reflective layer or having a reflector. The support can be selected according to the use of the photographic material.

the blue-sensitive emulsion, green-sensitive emulsion and red-sensitive emulsion for use in this invention are prepared by spectrally sensitizing each silver halide emulsion with, for example, a methine dye or others to impart each color sensitivity to each emulsion. Dyes which are used for this purpose include cyanine dyes, merocyanine dyes, complex cyanine dyes, complex meocyanine dyes, holopolar cyanine dyes, hemicyanine dyes, styryl dyes, and hemioxonole dyes. Particularly useful dyes are cyanine dyes, merocyanine dyes, and complex merocyanine dyes.

The color photographic material of this invention may has, in addition to the above-described photographic emulsion layers, auxiliary layers such as subbing layer, interlayers, a protective layer, etc. Also, if necessary, a second ultraviolet absorptive layer may be formed between the red-sensitive silver halide emulsion layer and the green-sensitive silver halide emulsion layer. It is preferred to use the above-described ultraviolet absorbent for the ultraviolet absorptive layer, but other known ultraviolet absorbents may be used.

As the binder or protective colloid for photographic emulsions, gelatin is advantageously, used but other hydrophilic colloids can also be used, including: gelating derivatives; graft polymers of gelatin with other high molecular materials; proteins such as albumin, casein, etc.; cellulose derivatives such as hydroxyethyl cellulose carboxymethyl cellulose, cellulose sulfuric acid esters, etc.; sugar derivatives such as sodium alginate, starch derivatives, etc.; and various synthetic hydrophilic polymers such as polyvinyl alcohol, polyvinyl alcohol partial acetal, poly-N-vinylpyrrolidone, polyacrylic acid, polymethacrylic acid, polyacrylamide, polyvinyl imidazole, polyvinyl pyrazole, etc.

As the gelatin, limed gelatin as well as acid-treated gelatin and enzyme-treated gelatin as described in *Bull. Soc. Sci. Phot. Japan,* No. 16, p. 30 (1966) can be used. Furthermore, the hydrolyzed products or enzyme decomposed products of gelatin can be used.

In the color photographic materials of this invention, the silver halide photographic emulsion layers and other hydrophilic colloid layers may further contain whitening agents such as stilbene series, triazine series, oxazole series, or cumarine series whitening agents. they may be water-soluble or may be in the form of a dispersion of a water-insoluble whitening agent. Practical examples of the whitening agents are described, for example, in U.S. Pat. Nos. 2,632,701, 3,269,840, and 3,359,102; U.K. Patent Nos. 852,075 and 1,319,763; *Research Disclosure,* Vol. 176, RD No. 17643, "Brighteners" on page 24, left column, line 9 to 36 (published 1978, December), etc.

When dyes or ultraviolet absorbents are incorporated in hydrophilic coloid layers of the color photographic materials of this invention, they may be mordanted by a cationic polymer. For this purpose, polymers that can be used include those described, for example, in U.K. Patent No. 685,475; U.S. Pat. Nos. 2,675,316, 2,839,401, 2,882,156, 3,048,487, 3,184,309, and 3,445,231; West German Patent Application (OLS) No. 1,914,362; Japanese Patent Application (OPI) Nos. 47,624/'75, 71,332/'75, etc.

The color photographic materials of this invention may further contain hydroquinone derivatives, aminophenol derivatives, gallic acid derivatives, ascorbic acid derivatives, etc., and specific examples thereof are described, for example, in U.S. Pat. Nos. 2,360,290, 2,336,327, 2,403,721, 2,418,613, 2,675,314, 2,701,197, 2,704,713, 2,728,659, 2,732,300, and 2,735,765; Japanese Patent Application (OPI) Nos. 92,988/'75, 92,989/'75, 93,928/'75, 110,337/'75, and 146,235/'77; Japanese Patent Publication No. 23,813/'75, etc.

The color photographic materials of this invention may further contain, if desired, various additives which are known in the art, such as stabilizers, antifoggants, surface active agents, couplers other than the above-described couplers of this invention, filter dyes, irradiation preventing dyes, developing agents, etc. Examples thereof are described, for example, in *Research Disclosure,* RD No. 17643.

Furthermore, as the case may be, the silver halide emulsion layers or other hydrophilic colloid layers of the photographic materials of this invention may further contain fine silver halide emulsion grains (e.g., silver chloride emulsion, silver bromide emulsion, or silver chlorobromide emulsion having a mean grain size of less than 0.20 micron) having substantially no light sensitivity.

A color developer for developing the color photographic materials of this invention is preferably an alkaline aqueous solution containing an aromatic primary amine color developing agent as the amine component. Examples of the color developing agent include, for example, 4-amino-N,N-diethylaniline, 3-methyl-4-N,N-diethylaniline, 4-amino-N-ethylN-β-hydroxyethylaniline, 3-methyl-4-amino-N-ethyl-β-hydroxyethylaniline, 3-methyl-4-amino-N-ethyl-N-β-methane-sulfonamidoethylaniline, 4-amino-3-methyl-N-ethyl-β-methoxyethylaniline, etc.

The color developer may further contain: a pH buffer such as a sulfite, carbonate, borate and phosphate of an alkali metal; a development inhibitor such as a bromide, an iodide, and an organic antifoggant; an antifoggant, etc. Also, the color developer may contain, if desired, a water softener; a preservative such as hydroxylamine, etc.; an organic solvent such as benzyl alcohol, diethylene glycol, etc.; a development accelerator such as polyethylene glycol, a quaternary ammonium salt, an amine, etc.; a dye-forming coupler, a competing coupler, a foggint agent such as sodium boronhydride, etc.; an auxiliary developing agent such as 1-phenyl-3-pyrazolidone, etc.; a tackifier; a polycarboxylic acid series chelating agent as described in U.S. Pat. No. 4,083,723; an antioxidant as described in West German Patent Application (OLS) No. 2,622,950, etc.

The color photographic material is usually bleached after color development. The bleach process may be performed together with a fix process or may be performed separately from the fix process. Examples of the fixing agent include compounds of polyvalent metals such as iron(III), cobalt(III), chromium(VI), copper(II), etc.; peracids; quinones; nitroso compounds, etc. For example, ferricyanides; bichromates; orgnic complex salts of iron(III) or cobalt(III) such as organic complex salts of aminopolycarboxylic acids (e.g., ethylenediaminetetraacetic acid, nitrilotriacetic acid, 1,3-diamino-2-propanoltetraacetic acid, etc.), cirtic acid, tartatic acid, malic acid, etc.; permanganates; persulfates; nitrosophenol, etc. Of these materials, potassium ferricyanide, ethylenediaminetetraacetic acid iron(III) sodium, and ethylenediaminetetraacetic acid iron(III) ammonium are particularly advantageous. The ethylenediaminetetraacetic acid iron(III) complex salt can be advantageous for a bleach liquid and a blix (i.e., bleach-fixing) liquid.

The color photographic materials may be washed with water after color development or blix process. The color development can be performed at an optional temperature between 18° C. and 55° C. The color development is performed at temperatures of higher than, preferably 30° C., and more preferably higher than 35° C. The developing time is in the range of about from 1 minute to about 3.5 minutes, but the time is better to be as short as possible. For a continuous development process, it is preferred to supplement a fresh developer and usually a fresh developer of 160 ml to 330 ml, preferably less than 100 ml per square meter of the processed area of color photographic material is supplemented. The concentration of benzyl alcohol in the color developer is preferably less than 5 ml/l.

The blix can be performed at temperatures of 18° C. to 50° C. but is preferably performed higher than 30° C. When the blix is performed at a temperature of higher than 35° C., the processing time can be shortened within one minute and the amount of the supplementing liquid can be reduced. The time required for water washing after color development or blixing is usually less than 3 minutes, but the time can be reduced to within one minute if desired by using a stabilization bath.

Colored dyes are generally subject to deterioration and fading by light, heat, or humidity as well as by molds. The deterioration by mold is particularly large in cyan dye images, and hence it is preferred to use an antimold agent. Specific examples of antimold agents are the 2-thiazolylbenzimidazoles as described in Japanese Patent Application (OPI) No. 157,244/'82. The antimold agent may be incorporated in the photographic materials or may be added in the development step from outside. The antimold agent may be incorporated or added to the photographic material in any step as long as the antimold agent is able to coexist with the processed photographic material.

Based on the foregoing description, it is seen that the merits of the color photographic materials of this invention include following:

First, in this invention, a color photographic material capable of providing color photographic images having good colors and excellent color reproducibility even it is developed in a developer prepared by hard water containing an alkaline earth metal ion can be obtained by the new combination of magneta coupler and cyan coupler.

Second, the color images thus obtained do not cause stains at the non-image areas even when the color images are exposed to heat, humidity, or light for a long period of time.

Third, the images thus formed show less fading and no deviation in color balance over the whole density range of the image portions.

Fourth, the color images containing various additives as described above show more improved stability to heat, humidity, or light.

The following example will still further illustrate the present invention.

EXAMPLE

Each of color photographic materials (Samples A to M) was prepared by coating the first layer (the lowermost layer) to the 7th layer (the uppermost layer) on a paper support having a polyethylene layers on both sides thereof as shown in Tables I and II described below.

The coating liquid for the first layer was prepared in the following manner. That is, 100 g of the yellow coupler shown in Table I below was dissolved in a mixture of 40 ml of trinonyl phosphate (TNP) and 200 ml of ethyl acetate and the solution was dispersed by emulsification in 800 g of an aqueous 10% gelatin solution containing 80 ml of an aqueous solution of 1% sodium dodecylbenzenesulfonate. Then, the total amount of the emulsified dispersion was mixed with 1450 g (containing 66.7 g of Ag) of a blue-sensitive silver chlorobromide emulsion (80% Br) to provide the coating liquid.

Coating liquids for other layers were also prepared by similar methods. For each layer, 2,4-dichloro-6-hydroxy-S-triazine sodium salt was used as a hardening agent.

Also, as a spectral sensitizer for each silver halide emulsion layer, the following compound was used.

Blue-sensitive emulsion layer:

3,3'-Di-(γ-sulfopropyl)-selenacyanine sodium salt ($2\times10^{-4}$ mole per mole of silver halide).

Green-sensitive emulsion layer:

3,3'-Di-(γ-sulfopropyl)-5,5'-diphenyl-9-ethylox-acabocyanine sodium salt ($2.5\times10^{-4}$ mole per mole of silver halide).

Red-sensitive emulsion layer:

3,3'-Di-(γ-sulfopropyl)-9-methyl-thia-dicarbocyanine sodium salt ($2.5\times10^{-4}$ mole per mole of silver halide).

Also, as an irradiation preventing dye for each silver halide emulsion layer, the following dye was used.

Green-sensitive emulsion layer:

-continued

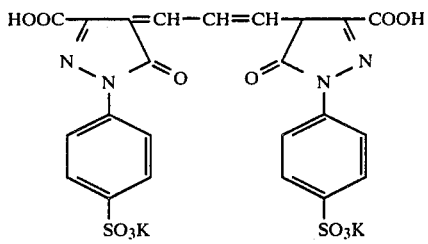

Red-sensitive emulsion layer:

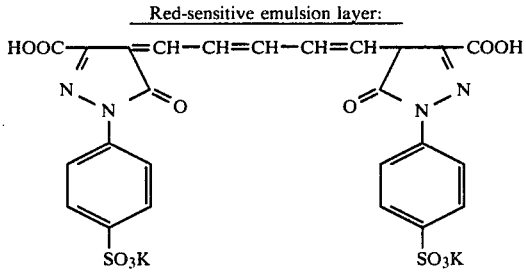

The chemical structures of compounds a to q and each solvent in Table I are as follows.

a;

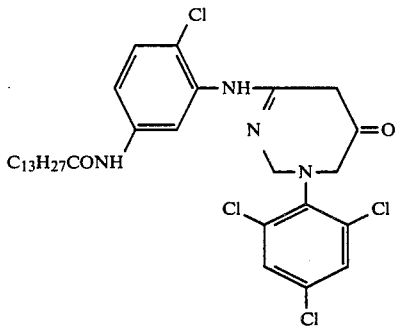

(Comparative four-equivalent magenta coupler)

b;

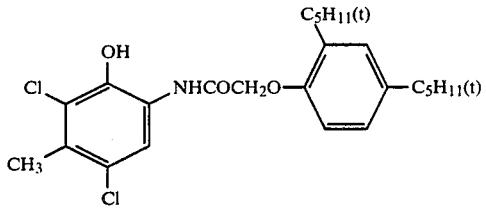

(Comparative cyan coupler)

c;

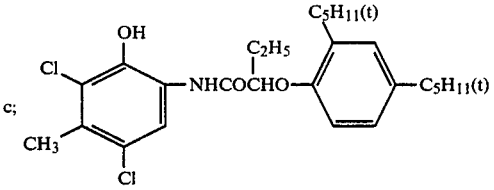

(Comparative cyan coupler)

d;

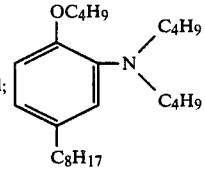

(Fading and stain preventing agent)

e;

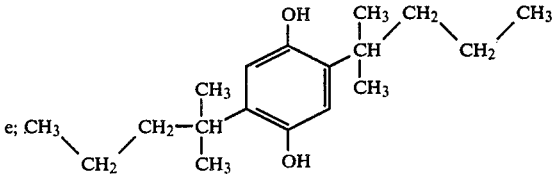

(Fading preventing agent)

f;

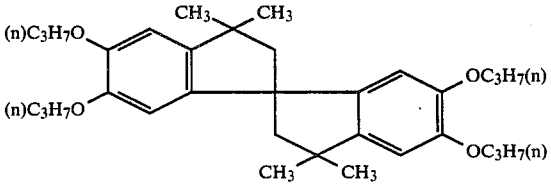

(Fading preventing agent)

-continued

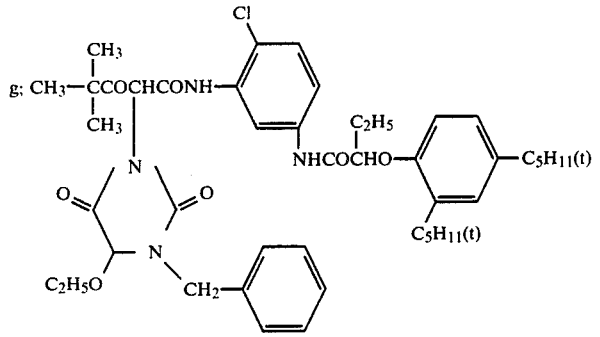

(Comparative yellow coupler)

TOP; $(C_8H_{17}O)_3-P=O$

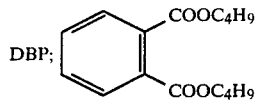

TNP; $(CH_{19}O)_3-P=O$

Each of the samples was gradation-exposed using an enlarger, Fuji Color Head 690 (trademark for product of Fuji Photo Film Co., Ltd.) so that the color density after development contained the portions of 1.0 and 2.0 in gray scale. Then, the sample was processed by the processing steps as described hereinbelow. Similarly, samples developed in the same manner without being exposed to light were also prepared. In these experiments, water used for the developer was hard water (containing 150 ppm of calcium ion and 50 ppm of magnesium ion).

| Processing step | Temperature | Time |
|---|---|---|
| Development | 33° C. | 3 min. 30 sec. |
| Blix | 33° C. | 1 min. 30 sec. |
| Wash | 28–35° C. | 3 min. |

The compositions of the processing liquids used for the processing steps were as follows.

| | |
|---|---|
| Developer | |
| Benzyl alcohol | 15 ml |
| Diethylene glycol | 8 ml |
| Ethylenediaminetetraacetic acid 2-sodium salt | 5 g |
| Sodium sulfite | 2 g |
| Hydroxylamine sulfate | 3 g |
| 4-amino-N—ethyl-N—(β-methanesulfonamidoethyl)-m-toluidine.$\frac{3}{2}$ sulfate.mono-hydrate | 5 g |
| Water to make | 1000 ml |
| | pH adjusted to 10.20 |
| Blix Liquid | |
| Ethylenediaminetetraacetic acid.di-sodium salt | 2 g |
| Ethylenediaminetetraacetic acid ferric salt | 40 g |
| Sodium sulfite | 5 g |
| Ammonium thiosulfate | 70 g |
| Water to make | 1000 ml |
| | pH adjusted to 6.80 |

Each of the sample thus developed was subjected to a fading and discoloring test by exposing the sample to a xenon tester (illuminance of 130,000 lux) for 3 days or 7 days.

Also, the sample were subjected to a fading and discoloring test by storing them in a chamber maintained at 60° C. and 70% RH for 2 weeks or 4 weeks.

The measurement of density was performed by blue light, green light or red light using a Macbeth densitometer, RD-514, whereby the density change of the initial densities of 1.0 and 2.0 was measured and also the density change (stain) of a blank (white) sample was measured.

Results obtained are shown in Table II and Table III. The stain density which corresponds to the yellow stain component was measured by blue light.

From the results shown below, the following matters are clearly seen:

(1) In Samples D to M of this invention, having the combination of the cyan coupler of formula (I) or (II) and the magenta coupler according to this invention, the formation of light-caused stain is remarkably lower than Comparison Samples A to C using none of the above-described combination or using one of the couplers only. In the samples of this invention, the formation of heat and humidity stain is also less and the white portions are not yellowed by light, heat, and humidity. This is an unexpected effect obtained by using the combination of the above-described cyan coupler and the magenta coupler.

(2) In Samples D to M of this invention using the combination of the cyan coupler and the magenta coupler according to this invention, the density change at both densities of a high density portion of D=0.2 and an intermediate density portion of D=1.0 of the image portions is less under light exposure or under high temperature and high humidity, and the changes of the three colors were balanced to maintain a neutral gray state. On the other hand, in Comparison Samples A to C, the gray color become greenish due to considerable fading of the magenta color and further in Comparison Samles A and C, and the gray color became reddish due to considerable fading of the cyan color in the dark fading test.

Furthermore, in the comparison of the test results of Samples D to M of this invention, the difference between Samples E and F or between Samples J and K is based on the presence or absence of Compound d, which shows the formation of light stain is further reduced by the use of Compound d in the green-sensitive layer. Still further, as is clear from the comparison of the test results of Samples D and E, the case of using Compound M-2 corresponding to the magenta coupler of formula (III) wherein $R_7$ is a substituted alkyl group shows less light stain than the case of using Compound M-16 corresponding to the magenta coupler of formula (III), wherein $R_7$ is an unsubstituted alkyl group, and in the former case, the formation of dark heat stain is more remarkably reduced.

TABLE I

| | Sample No. | A | B | C | D | E | F | G | H | I | J | K | L | M |
|---|---|---|---|---|---|---|---|---|---|---|---|---|---|---|
| 7th Layer (Protective Layer) | Coated Amount of Gelatin | 1500 mg/m$^2$ | " | " | " | " | " | " | " | " | " | " | " | " |
| 6th Layer (Ultraviolet Absorption Layer | Gelatin Coated Amount | 1500 mg/m$^2$ | " | " | " | " | " | " | " | " | " | " | " | " |
| | Kind of Ultraviolet Absorbent | UV-3/UV-1/UV-4 | " | " | " | " | " | " | " | " | " | " | " | " |
| | Coated Amount of Ultraviolet Absorbent | 50/150/300 mg/m$^2$ | " | " | " | " | " | " | " | " | " | " | " | " |
| | Kind of Ultraviolet Absorbent Solvent | TNP | | | | | | | | | | | | |
| | Coated of Ultraviolet Absorbent Solvent | 200 mg/m$^2$ | " | " | " | " | " | " | " | " | " | " | " | " |
| 5th Layer (Red-Sensitive Layer) | Ag-Amount of Silver Chlorobromide Emulsion (Br 50%) | 250 mg/m$^2$ | " | " | " | " | " | " | " | " | " | " | " | " |
| | Kind of Cyan Coupler | b/c | C-5 | b | C-5/b | " | " | C-11 | C-41 | " | C-5/C-41 | " | C-51/b | " |
| | Coated Amount of Cyan Coupler | 90/300 mg/m$^2$ | 500 | 400 | 250/200 | " | " | 600 | 450 | " | 200/250 | " | 300/200 | " |
| | Kind of Cyan Coupler Solvent | DHF | " | " | " | " | " | " | " | " | " | " | " | " |
| | Coated Amount of Cyan Coupler Solvent | 240 mg/m$^2$ | 300 | 240 | 300 | " | " | 400 | 300 | " | " | " | " | " |
| 4th Layer (Ultraviolet Absorptive Layer) | Gelatin Coated Amount | 2000 mg/m$^2$ | " | " | " | " | " | " | " | " | " | " | " | " |
| | Kind of Ultraviolet Absorbent | UV-3/UV-1/UV-4 | " | " | " | " | " | " | " | " | " | " | " | " |
| | Coated Amount of Ultraviolet Absorbent | 15/45/90 mg/m$^2$ | " | " | " | " | " | " | " | " | " | " | " | " |
| | Kind of Ultraviolet Absorbent Solvent | TNP | " | " | " | " | " | " | " | " | " | " | " | " |
| | Coated Amount of Ultraviolet Absorbent Solvent | 60 mg/m$^2$ | " | " | " | " | " | " | " | " | " | " | " | " |
| 3rd Layer (Green-Sensitive Layer) | Ag-Amount of Silver Chlorobromide (Br 70%) | 450 mg/m$^2$ | " | 200 | " | " | " | " | " | " | " | " | " | " |
| | Kind of Magenta Coupler | a | " | M-16 | " | M-2 | " | " | " | M-6 | " | " | " | M-3 |
| | Coated Amount of Magenta Coupler | 350 mg/m$^2$ | " | 300 | " | 350 | " | " | " | " | " | " | " | 300 |
| | Kind of Magenta Coupler Solvent | TOP | " | " | " | " | " | " | " | " | " | " | " | " |
| | Coated Amount of Magenta Coupler Solvent | 440 mg/m$^2$ | " | 270 | " | " | " | " | " | " | " | " | " | " |
| Kind of Fading Preventing Agent | e/f | " | " | " | " | d/e/f | " | " | e/f | " | d/e/f | " | e/f | |
| | Coated Amount of Fading Preventing Agent | 70/120 mg/m$^2$ | " | 60/100 | " | " | 150/60/100 | " | " | 60/100 | " | 150/60/100 | " | 60/100 |
| 2nd Layer (Fading Preventing Layer) | Gelatin Coated Amount | 1500 mg/m$^2$ | " | " | " | " | " | " | " | " | " | " | " | " |
| 1st Layer (Blue-Sensitive Layer) | Ag-Amount of Silver Chlorobromide Emulsion (Br 80%) | 400 mg/m$^2$ | " | " | " | " | " | " | " | " | " | " | " | " |
| | Kind of Yellow Coupler | g | " | " | " | " | " | " | " | " | " | " | " | " |
| | Coated Amount of Yellow Coupler | 600 mg/m$^2$ | " | " | " | " | " | " | " | " | " | " | " | " |
| | Kind of Yellow Coupler Solvent | TNP | " | " | " | " | " | " | " | " | " | " | " | " |
| | Coated Amount of Yellow Coupler | 240 mg/m$^2$ | " | " | " | " | " | " | " | " | " | " | " | " |

TABLE I-continued

| Sample No. | A | B | C | D | E | F | G | H | I | J | K | L | M |
|---|---|---|---|---|---|---|---|---|---|---|---|---|---|
| Solvent | | | | | | | | | | | | | |
| Support | | | | | Paper Support both Side of which is Coated with Polyethylene | | | | | | | | |

Samples A to C: Comparison Samples
Samples D to M: Samples of the Invention
" represents the same as shown in each left column

TABLE II

| | | | Light-Fading Test | | | | | | | | | | | | |
|---|---|---|---|---|---|---|---|---|---|---|---|---|---|---|---|
| | | | A | B | C | D | E | F | G | H | I | J | K | L | M |
| Xernon Tester | Initial | Y | 0.95 | 0.95 | 0.97 | 0.98 | 0.98 | 0.97 | 0.97 | 0.98 | 0.97 | 0.98 | 0.98 | 0.96 | 0.97 |
| (130,000 Lux) | Density | M | 0.80 | 0.82 | 0.97 | 0.97 | 0.96 | 0.98 | 0.98 | 0.97 | 0.96 | 0.96 | 0.98 | 0.97 | 0.98 |
| Irradiation for 3 days | 1.0 | C | 0.98 | 0.95 | 0.98 | 0.97 | 0.97 | 0.98 | 0.97 | 0.98 | 0.98 | 0.97 | 0.97 | 0.96 | 0.97 |
| | Initial | Y | 1.97 | 1.96 | 1.95 | 1.97 | 1.98 | 1.98 | 1.96 | 1.97 | 1.99 | 1.98 | 1.96 | 1.97 | 1.98 |
| | Density | M | 1.82 | 1.83 | 1.92 | 1.92 | 1.95 | 1.98 | 1.97 | 1.98 | 1.98 | 1.97 | 1.96 | 1.98 | 1.98 |
| | 2.0 | C | 1.98 | 1.94 | 1.97 | 1.96 | 1.97 | 1.97 | 1.96 | 1.98 | 1.98 | 1.97 | 1.98 | 1.96 | 1.97 |
| | Stain | | 0.05 | 0.05 | 0.04 | 0.03 | 0.02 | 0.02 | 0.02 | 0.03 | 0.02 | 0.02 | 0.02 | 0.02 | 0.03 |
| Xenon Tester | Initial | Y | 0.88 | 0.90 | 0.90 | 0.91 | 0.91 | 0.93 | 0.92 | 0.93 | 0.92 | 0.92 | 0.91 | 0.92 | 0.92 |
| (130,000 Lux) | Density | M | 0.65 | 0.67 | 0.85 | 0.85 | 0.88 | 0.92 | 0.92 | 0.93 | 0.90 | 0.89 | 0.93 | 0.94 | 0.90 |
| Irradiation for 7 days | 1.0 | C | 0.92 | 0.89 | 0.92 | 0.90 | 0.91 | 0.90 | 0.90 | 0.92 | 0.92 | 0.91 | 0.91 | 0.90 | 0.90 |
| | Initial | Y | 1.90 | 1.89 | 1.91 | 1.89 | 1.90 | 1.92 | 1.92 | 1.92 | 1.93 | 1.92 | 1.91 | 1.92 | 1.92 |
| | Density | M | 1.70 | 1.72 | 1.82 | 1.82 | 1.86 | 1.93 | 1.93 | 1.94 | 1.86 | 1.87 | 1.93 | 1.93 | 1.90 |
| 2.0 | C | 1.92 | 1.90 | 1.92 | 1.91 | 1.92 | 1.92 | 1.90 | 1.93 | 1.92 | 1.91 | 1.91 | 1.90 | 1.90 | |
| | Stain | | 0.18 | 0.16 | 0.08 | 0.07 | 0.06 | 0.04 | 0.04 | 0.04 | 0.05 | 0.05 | 0.03 | 0.03 | 0.04 |

TABLE III

| | | | Dark Fading Test | | | | | | | | | | | | |
|---|---|---|---|---|---|---|---|---|---|---|---|---|---|---|---|
| | | | A | B | C | D | E | F | G | H | I | J | K | L | M |
| Stored for 2 Weeks | Initial | Y | 1.00 | 1.01 | 1.00 | 0.99 | 1.00 | 1.01 | 1.00 | 1.00 | 1.01 | 1.00 | 1.01 | 1.00 | 1.00 |
| at 60° C., 70% RH | Density | M | 0.99 | 0.99 | 0.99 | 0.99 | 0.98 | 0.98 | 0.98 | 0.98 | 0.98 | 0.99 | 0.98 | 0.98 | 0.98 |
| | 1.0 | C | 0.96 | 0.99 | 0.95 | 0.98 | 0.98 | 0.98 | 0.99 | 0.98 | 0.98 | 0.99 | 0.96 | 0.97 | 0.97 |
| | Initial | Y | 2.01 | 2.00 | 2.00 | 2.00 | 1.99 | 1.99 | 1.99 | 1.98 | 1.98 | 1.99 | 1.99 | 1.99 | 1.99 |
| | Density | M | 1.96 | 1.97 | 1.98 | 1.98 | 1.97 | 1.98 | 1.98 | 1.98 | 1.97 | 1.97 | 1.97 | 1.98 | 1.97 |
| | 2.0 | C | 1.92 | 1.99 | 1.91 | 1.98 | 1.98 | 1.97 | 1.98 | 1.97 | 1.97 | 1.98 | 1.98 | 1.98 | 1.98 |
| | Stain | | 0.04 | 0.05 | 0.04 | 0.03 | 0.02 | 0.01 | 0.01 | 0.01 | 0.02 | 0.02 | 0.01 | 0.02 | 0.02 |
| Stored for 4 Weeks | Initial | Y | 1.02 | 1.01 | 0.99 | 0.99 | 0.98 | 0.99 | 0.99 | 0.99 | 0.99 | 1.00 | 0.99 | 0.99 | 0.99 |
| at 60° C., 70% RH | Density | M | 0.96 | 0.96 | 0.98 | 0.98 | 0.96 | 0.97 | 0.98 | 0.98 | 0.97 | 0.97 | 0.98 | 0.97 | 0.98 |
| | 1.0 | C | 0.80 | 0.97 | 0.81 | 0.96 | 0.96 | 0.96 | 0.97 | 0.96 | 0.96 | 0.97 | 0.95 | 0.95 | 0.96 |
| | Initial | Y | 2.01 | 2.00 | 1.98 | 1.99 | 1.99 | 1.98 | 1.99 | 1.99 | 2.00 | 2.01 | 1.99 | 1.99 | 1.98 |
| | Density | M | 1.95 | 1.96 | 1.98 | 1.98 | 1.96 | 1.97 | 1.96 | 1.97 | 1.96 | 1.96 | 1.96 | 1.97 | 1.97 |
| | 2.0 | C | 1.57 | 1.96 | 1.58 | 1.92 | 1.92 | 1.93 | 1.96 | 1.96 | 1.96 | 1.95 | 1.95 | 1.95 | 1.96 |
| | Stain | | 0.18 | 0.19 | 0.07 | 0.06 | 0.03 | 0.02 | 0.02 | 0.02 | 0.03 | 0.03 | 0.03 | 0.03 | 0.03 |

While the invention has been described in detail and with reference to specific embodiments thereof, it will be apparent to one skilled in the art that various changes and modifications can be made therein without departing from the spirit and scope thereof.

What is claimed is:

1. A color photographic material comprising a support having thereon (i) a silver halide emulsion layer containing a compound represented by formula (I) or (II), and (ii) a silver halide emulsion layer containing a 5-pyrazolone coupler having an arylthio group at the coupling position of said coupler, wherein said arylthio group includes an aliphatic oxy group or an aromatic oxy group at an ortho-position with respect to the sulfur atom of the arylthio group, the aliphatic group or aromatic group of said aliphatic oxy group or aromatic oxy group being unsubstituted or substituted by at least one member selected from (a) a halogen atom, (b) a cyano group, (c) an unsubstituted or substituted aliphatic, aromatic, or heterocyclic sulfonyl, sulfinyl, or phosphonyl group, and (d) a group represented by the formula $$-A_1-\underset{\underset{O}{\|}}{C}-B_1$$

wherein $A_1$ represents a single bond, an oxygen atom, a sulfur atom, an imino group, or a divalent aliphatic, aromatic, or heterocyclic group and $B_1$ represents a hydroxy group, an aliphatic or aromatic oxy group, a hydrogen atom, an aliphatic group, an aromatic group, a heterocyclic group, an unsubstituted or substituted noncyclic amino group, or an unsubstituted or substituted hydrazino group, and (e) a group represented by the formula $$-(A_2-M)_nB_2$$

wherein $A_2$ represents a single bond, a divalent aliphatic, aromatic, or heteropcyclic group, $B_2$ represents a hydrogen atom, an aliphatic group, an aromatic group or a heterocyclic group, M represents an oxygen atom, a sulfur atom, or an imino group, and n represents an integer of 1 to 4; and formulae (I) and (II) are represented by

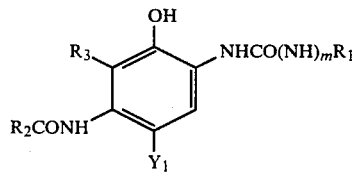

(I)

and

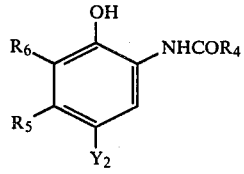

(II)

wherein $R_1$, $R_2$, and $R_4$ each represents an unsubstituted or substituted aliphatic group, an unsubstituted or substituted aromatic group, or an unsubstituted or substituted heterocyclic group; $R_3$ and $R_6$ each represents a hydrogen atom, a halogen atom, an aliphatic group, or an acylamino group; or $R_2$ and $R_3$ together represent a non-metallic atomic group forming a nitrogen-containing 5-membered or 6-membered ring; $R_5$ represents an unsubstituted or substituted aliphatic group containing at least 2 carbon atoms; $Y_1$ and $Y_2$ each represents a hydrogen atom or a group capable of being released during oxidative coupling with a developing agent; and m represents 0 or 1; and said coupler can form a dimer or higher oligomer coupler by linking through a group of the groups represented by $R_2$, $R_3$, and $Y_1$ or the groups represented by $R_5$, $R_6$, and $Y_2$.

2. A color photographic material as in claim 1, wherein $R_1$ is an aryl group or a heterocyclic group; $R_2$ is an unsubstituted or substituted alkyl group; $R_3$ is a hydrogen atom; $R_4$ is an unsubstituted or substituted alkyl group or an unsubstituted or substituted aryl group; $R_5$ is an alkyl group having from 2 to 15 carbon atoms or a methyl group having a substituent of one or more carbon atoms; $R_6$ is a hydrogen atom or a halogen atom; and $Y_1$ and $Y_2$ each represents a hydrogen atom, a halogen atom, an alkoxy group, an aryloxy group, an acyloxy group, or a sulfonamido group.

3. A color photographic material as in claim 1, wherein the 5-pyrazolone coupler is represented by formula (III)

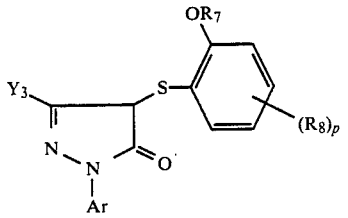

(III)

wherein Ar represents a phenyl group substituted by at least one halogen atom, alkyl group, alkoxy group, alkoxycarbonyl group, or cyano group; $R_7$ represents an unsubstituted aliphatic or aromatic group or an aliphatic or aromatic group substituted by (a) a halogen atom, (b) a cyano group, (c) an aliphatic, aromatic or heterocyclic sulfonyl, sulfinyl or phosphonyl group, (d)

$$-A_1-\underset{\underset{O}{\|}}{C}-B_1,$$

or (e) $-(A_2-M)_nB_2$, wherein $A_1$, $B_1$, $A_2$, M, $B_2$, and n have the same meanings as defined in claim 1; $R_8$ represents a hydrogen atom, a halogen atom, a hydroxy group, an alkyl group, an alkoxy group, an aryl group, an amino group, an acylamino group, a ureido group, an alkoxycarbonylamino group, an imido group, a sulfonamido group, a sulfamoyl group, a sulfamoylamino group, a nitro group, an alkoxycarbonyl group, a carbamoyl group, an acyl group, a cyano group or an alkylthio group; $Y_3$ represents an acylamino group or an anilino group; and p represents an integer of 1 to 4.

4. A color photographic material as in claim 3, wherein the 5-pyrazolone coupler is represented by formula (IV)

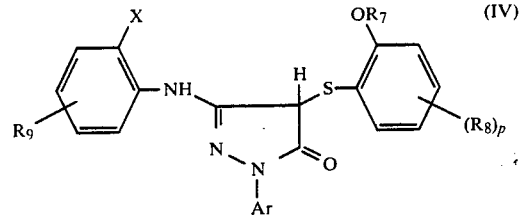

(IV)

wherein $R_7$, $R_8$, Ar, and p have the same meanings as defined for formula (III) in claim 3; X represents a halogen atom or an alkoxy group; and $R_9$ represent a hydrogen atom, a halogen atom, an alkyl group, an allkoxy group, an acylamino group, a sulfonamido group, a sulfamoyl group, a carbamoyl group, a diacylamino group, an alkoxycarbonyl group, an alkoxysulfonyl group, an aryloxysulfonyl group, an alkanesulfonyl group, an arylsulfonyl group, an alkylthio group, an arylthio group, an alkyloxy-carbonylamino group, an alkylureido group, an acyl group, a nitro group, a carboxy group, or a trichloromethyl group.

5. A color photographic material as in claim 1, wherein the amount of magenta coupler is from $2\times10^{-3}$ mole to $5\times10^{-1}$ mole per mole of silver in the silver halide photographic emulsion.

6. A color photographic material as in claim 1, wherein the amount of cyan coupler is from $2\times10^{-3}$ mole to $5\times10^{-1}$ mole per mole of silver in the silver halide photographic emulsion.

7. A color photographic material as in claim 1, wherein a molar ratio of cyan coupler/magenta coupler in the range of 1/about 0.2 to 1.5.

8. A color photographic material as in claim 1, wherein the photographic material has (iii) a silver halide emulsion layer containing a yellow coupler.

9. A color photographic material as in claim 8, wherein said yellow coupler is a compound represented by formula (V)

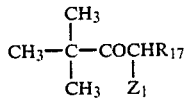

(V)

wherein $R_{17}$ represents an unsubstituted or substituted N-phenylcarbamoyl group and $Z_1$ represents a hydrogen atom or a group capable of releasing at the coupling reaction with the oxidation product of a developing agent; said coupler may form a dimer or higher oligomer by linking through $Z_1$.

10. A color photographic material as in claim 1, wherein the photographic material contains an ultraviolet absorbent.

11. A color photographic material as in claim 10, wherein said absorbent is a compound represented by formula (VI)

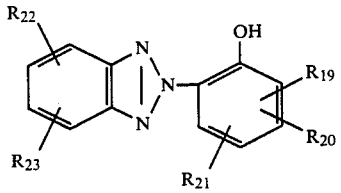

(VI)

wherein $R_{19}$, $R_{20}$, $R_{21}$, $R_{22}$ and $R_{23}$ each represents (i) a hydrogen atom or (ii) a group the same as the substituent for an aromatic group shown by $R_1$ or $R_4$ in formula (I) or (II) in claim 1, or (iii) $R_{22}$ and $R_{23}$ together form a 5- or 6-membered aromatic carbon ring, or (iv) a further substituted group of (i), (ii), or (iii) with a group the same as the substituent defined in (ii).

* * * * *